US010913583B2

(12) United States Patent
Sanguinet et al.

(10) Patent No.: US 10,913,583 B2
(45) Date of Patent: Feb. 9, 2021

(54) CHILD RESISTANT SENIOR FRIENDLY CAN TOPPER MECHANISM

(71) Applicant: Berlin Packaging, LLC, Chicago, IL (US)

(72) Inventors: Andrew Sanguinet, La Grange Park, IL (US); Brett Niggel, Chicago, IL (US)

(73) Assignee: Berlin Packaging, LLC, Chicago, IL (US)

( * ) Notice: Subject to any disclaimer, the term of this patent is extended or adjusted under 35 U.S.C. 154(b) by 0 days.

(21) Appl. No.: 15/931,624

(22) Filed: May 14, 2020

(65) Prior Publication Data

US 2020/0270033 A1 Aug. 27, 2020

Related U.S. Application Data

(63) Continuation-in-part of application No. 16/288,189, filed on Feb. 28, 2019.

(60) Provisional application No. 62/751,007, filed on Oct. 26, 2018.

(51) Int. Cl.
*B65D 50/04* (2006.01)
*B65D 17/28* (2006.01)

(52) U.S. Cl.
CPC ..... *B65D 50/046* (2013.01); *B65D 17/4012* (2018.01); *B65D 2215/02* (2013.01); *B65D 2251/0071* (2013.01); *B65D 2517/0014* (2013.01)

(58) Field of Classification Search
CPC ..... B65D 17/00; B65D 17/02; B65D 17/06; B65D 17/28; B65D 17/42; B65D 51/20; B65D 43/14; B65D 43/16; B65D 50/00; B65D 50/02; B65D 55/02; B65D 77/2028; B65D 77/10; B65D 77/20; B65D 2577/10; B65D 2577/2041; B65D 2577/20; B65D 2577/205; B65D 2577/2058; B65D 2577/2075
USPC ..... 220/269, 270, 272, 273, 716, 712; 206/139–151; 215/201
See application file for complete search history.

(56) References Cited

U.S. PATENT DOCUMENTS 3,664,497 A * 5/1972 Mascia ..... B65D 17/4012 206/151
4,582,216 A * 4/1986 Byrd ..... B65D 17/506 220/260
4,682,702 A * 7/1987 Gach ..... B65D 47/103 215/235

(Continued)

FOREIGN PATENT DOCUMENTS

EP 1945521 5/2013

OTHER PUBLICATIONS

PCT International Search Report for corresponding PCT Application, App. Ser. No. PCT/US2019/05172; dated Feb. 7, 2020 date of ISR.

*Primary Examiner* — Kareen K Thomas
(74) *Attorney, Agent, or Firm* — Adam K. Sacharoff; Much Shelist P.C.

(57) ABSTRACT

There is shown in embodiments of a closure mechanism configured to fit over the top of the can and prevent access. The closure mechanism is a child resistant senior friendly mechanism that can be opened and removed by the senior when access to the can is desired. The closure mechanism is designed for a single use as once removed it will no longer prevent access of the top of the can.

20 Claims, 23 Drawing Sheets

(56) References Cited

U.S. PATENT DOCUMENTS 4,911,288 A * 3/1990 Dantoin, Jr. ..... B65D 71/42 206/139
5,054,640 A * 10/1991 Tucker ..... B65D 43/0212 220/254.3
5,080,245 A * 1/1992 Conard ..... B65D 51/002 215/249
5,108,003 A * 4/1992 Granofsky ..... B65D 17/506 220/257.2
5,139,163 A * 8/1992 Diaz ..... B65D 51/20 220/258.2
5,562,205 A * 10/1996 Diaz ..... B65D 71/50 206/151
5,582,314 A * 12/1996 Quinn ..... B65D 47/0885 215/237
6,290,084 B1 9/2001 Louie
6,626,314 B1 * 9/2003 McHenry ..... B65D 47/265 220/254.2
7,017,769 B1 * 3/2006 Talmon ..... B65D 43/0212 220/258.1
8,113,374 B2 * 2/2012 Steiger ..... B65D 51/20 220/258.4
8,695,842 B2 * 4/2014 Gonzalez Sanchez ..... B65D 51/007 220/716
8,720,740 B2 * 5/2014 Bratsch ..... B65D 47/265 220/821
D751,920 S * 3/2016 Aranda Campin .... B65D 17/28 D9/711
D776,487 S * 1/2017 Peeters ..... D7/608
D854,877 S * 7/2019 Kohlendorfer ..... D7/391
2006/0289548 A1 * 12/2006 Schatz ..... B65D 17/4014 220/784
2007/0295737 A1 * 12/2007 Del Val Catala .. B65D 17/4012 220/716
2008/0006630 A1 * 1/2008 Messina ..... B65D 17/4012 220/257.2
2010/0059471 A1 * 3/2010 Pehr ..... B65D 55/14 215/201
2012/0138621 A1 * 6/2012 Bratsch ..... B65D 17/4014 220/780
2012/0267336 A1 10/2012 Faragher et al.
2018/0134464 A1 * 5/2018 Battaglia ..... A47G 23/0266

* cited by examiner

CHILD RESISTANT SENIOR FRIENDLY CAN TOPPER MECHANISM

CROSS REFERENCE TO RELATED INVENTIONS

The present application is a Continuation in Part of U.S. application Ser. No. 16/288,189 filed Feb. 28, 2019, which claims priority to U.S. Provisional Application 62/751,007 filed Oct. 26, 2018. Both applications are hereby incorporated herein by reference.

FIELD OF THE INVENTION

The present invention relates to a safety top that can be mounted and removed from the top of a can, which provides for a means to prevent a child from gaining easy access to the contents of the can.

BACKGROUND OF THE INVENTION

The contents of cans can include various liquids that while usually are not harmful to children may present an issue if the contents include a harmful liquid. Since cans are a relatively mainstream container children at very young ages are provided access and shown how to open the cans by themselves. Children learn how to open the cans either by using a finger or by leveraging an object, such as a fork or spoon, under the lift end of the tab and simply applying an upward force causing the nose end of the tab to press down breaking the score and opening the can. While the entire can and the opening mechanism can be completely redeveloped to meet the needs defined herein, there is a much simpler manner to accomplish the task. As such there is a desire in providing a child resistant adult/senior friendly closure mechanism that fits over the top of the can.

SUMMARY OF THE INVENTION

In one embodiment of the present invention there is provided a child resistant adult/senior friendly closure mechanism that fits over the top of the can. When secured the top of the can and thus the tab remains inaccessible to the user. The closure mechanism id designed as a child resistant cover that can be removed by an adult and which then provides access to the top of the can.

As provided in one or more embodiments of the present invention, there is provided a child resistant closure mechanism configured for use with a typical can that has a ledge surrounding a top portion of the can and which contents of the can are accessible from the top portion when the can is opened. The closure mechanism has a base defining a base skirt configured to secure to the ledge of the can and has a cover hinged to the base along one end. The cover is configurable into a closed configuration with the base to prevent access to the top portion of the can and moveable into an open configuration with the base to permit access. The closure mechanism includes a removable pull tab connected to a portion of the base accessible only when the cover is in the open configuration. A pair of frangible notches on either side of the portion of the base by the removable pull tab causes the portion of the base to break and remove when the removable pull tab is removed. Once the portion of the base breaks away from the base, the base is removable from the ledge of the can to provide access to the top portion of the can and thus the contents.

The closure mechanism further includes a manual manipulative locking mechanism configured to secure the cover and base in the closed configuration. The manual manipulative locking mechanism is configured for manual manipulation to release the cover from the base such that the cover may move into the open configuration. The manual manipulative locking mechanism includes a pinch lock mechanism and a front end locking mechanism working in concert with each other to secure the cover and base in the closed configuration. This requires a two fold action of pinching and lifting making the closure mechanism conform to child safety regulations.

The closure mechanism may further include a base defined to have an annular ring with an outer peripheral edge and an inner peripheral edge to define a base surface there between. An inside base skirt extends downwardly from the inner peripheral edge and an outside base skirt extends downwardly from the outer peripheral edge. The outside base skirt has inwardly extending tabs configured to grip under the ledge of the can when the closure mechanism is secured onto a can.

The closure mechanism may further define arcuate slots along the annular ring on the base surface adjacent the inwardly extending tabs configured to permit deflection of the annular ring and prevent tampering with the base.

The closure mechanism may further define the cover to have a top surface terminating at a top peripheral edge to a downwardly extending top skirt. The top surface is configured to cover a substantial portion of the top portion of the can when the cover and base are in the closed configuration.

The pinch lock mechanism may be defined by including a pair of arms diametrically opposed to each other and each extending from the base skirt inwardly towards each other. Each arm has a flange extending upwardly above the base, and a projection tab positioned on an outside surface of the flange. A pair of slots separately corresponds to the pair of arms. Each slot would be defined in a top surface on the cover to receive a flange when the cover and base are in the closed configuration. Each slot includes a projection member configured to act in concert with the projection tab on the flange to secure the flanges and lock the cover and base in the closed configuration. Each flange is resiliently secured to the base such that the flanges when manually manipulated towards each other cause the projection tab to release the projection member such that the cover and base are movable to the open configuration.

The front end locking mechanism may include a catch positioned on an edge of the cover working in concert with a bead positioned on a boss extending from the base. The front end click lock mechanism is configured to open by applying an upward force on a lip extending from the cover to overcome a frictionally force between the bead and catch.

The mechanism for multiple cans may include a plurality of the closure mechanisms of joined together at a periphery by a frangible link and in substantially the same plane, and wherein the frangible link when broken permits separation of one closure mechanism secured to a can from the plurality.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE DRAWINGS

Figure 1:
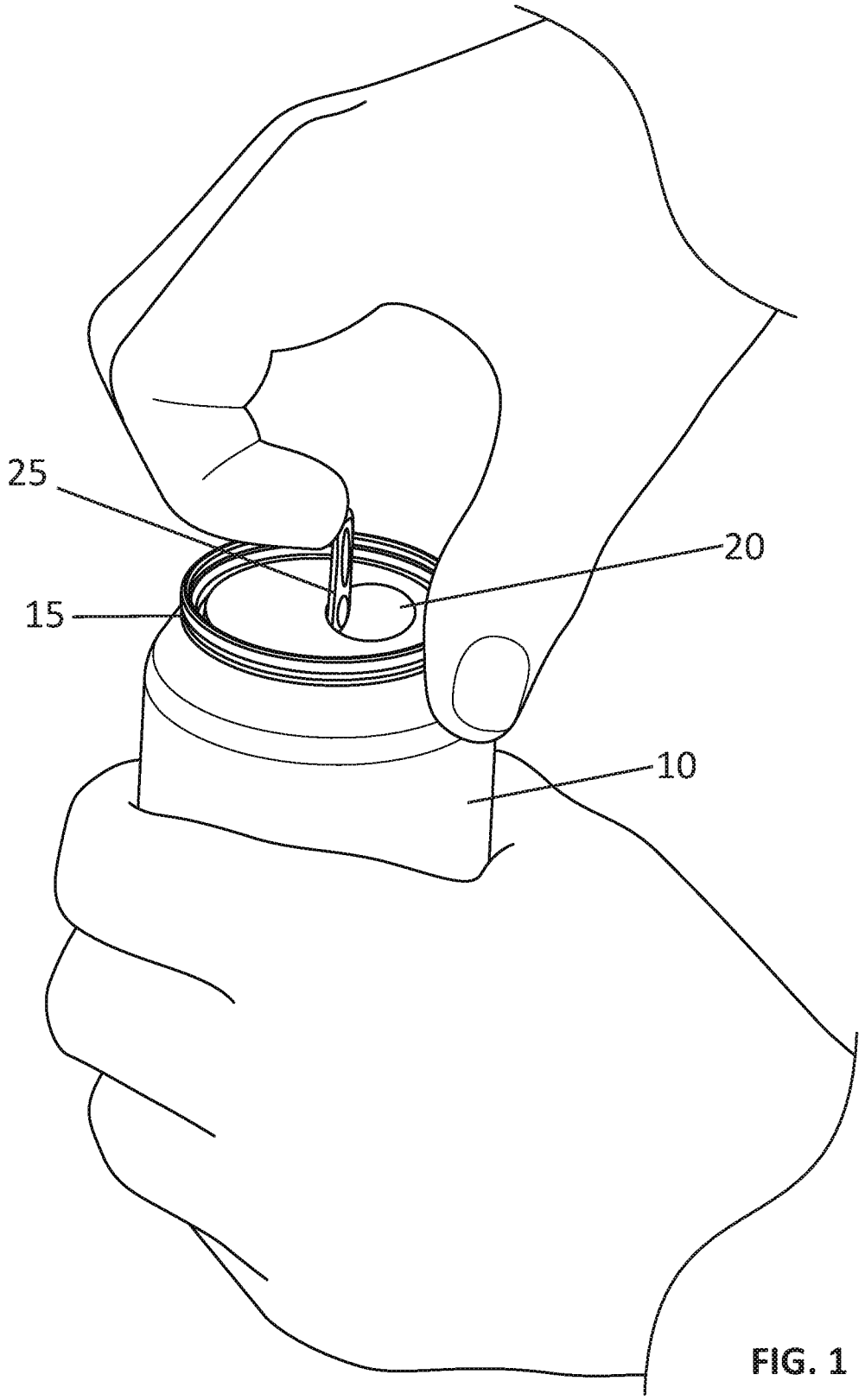
FIG. 1 is an illustration of a user opening a typical can.
Figure 2A:
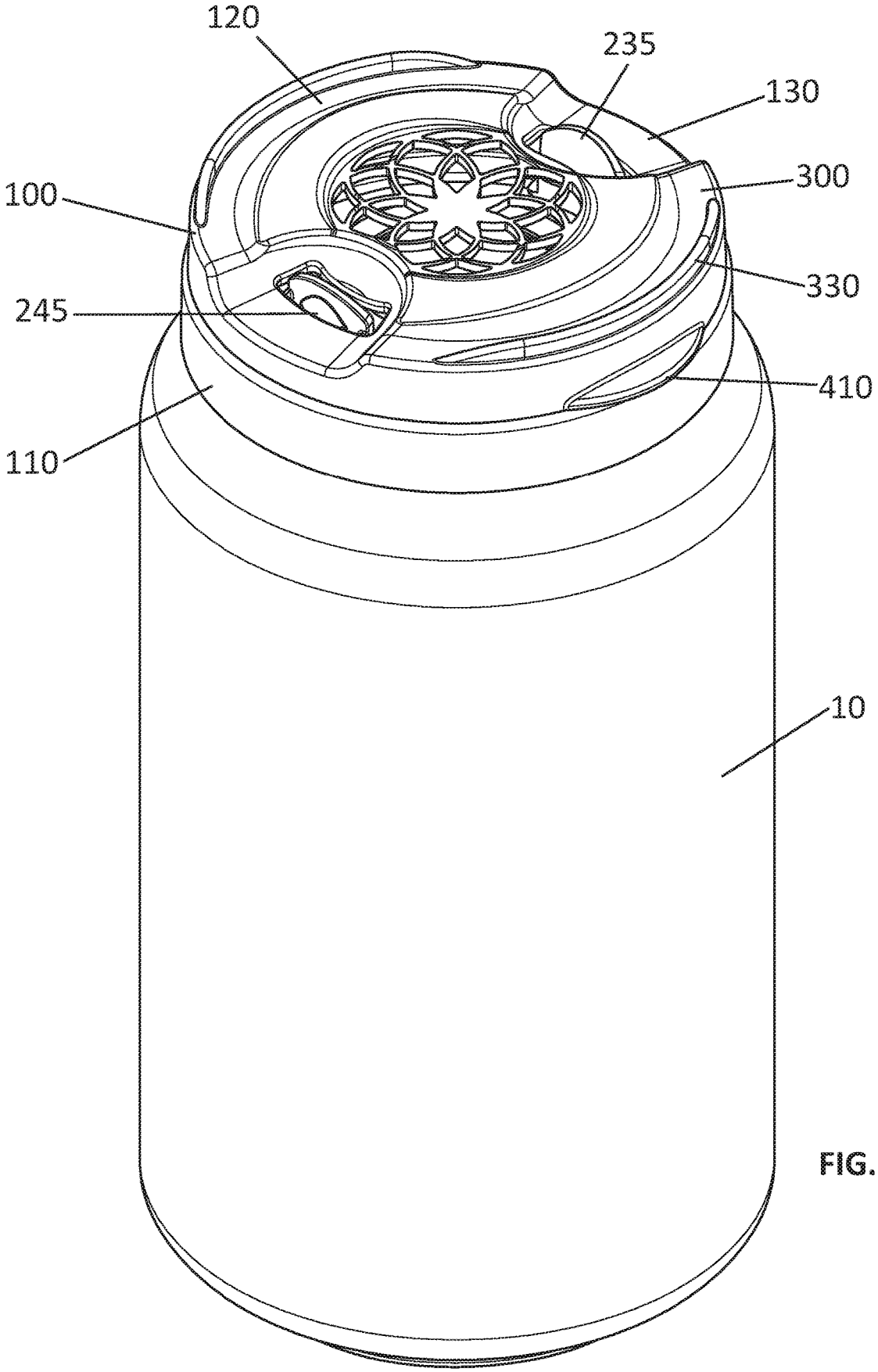
FIG. 2A is a perspective view of a closure mechanism secured to a can and illustrated in a closed configuration in accordance with one or more embodiments of the present invention.
Figure 2B:
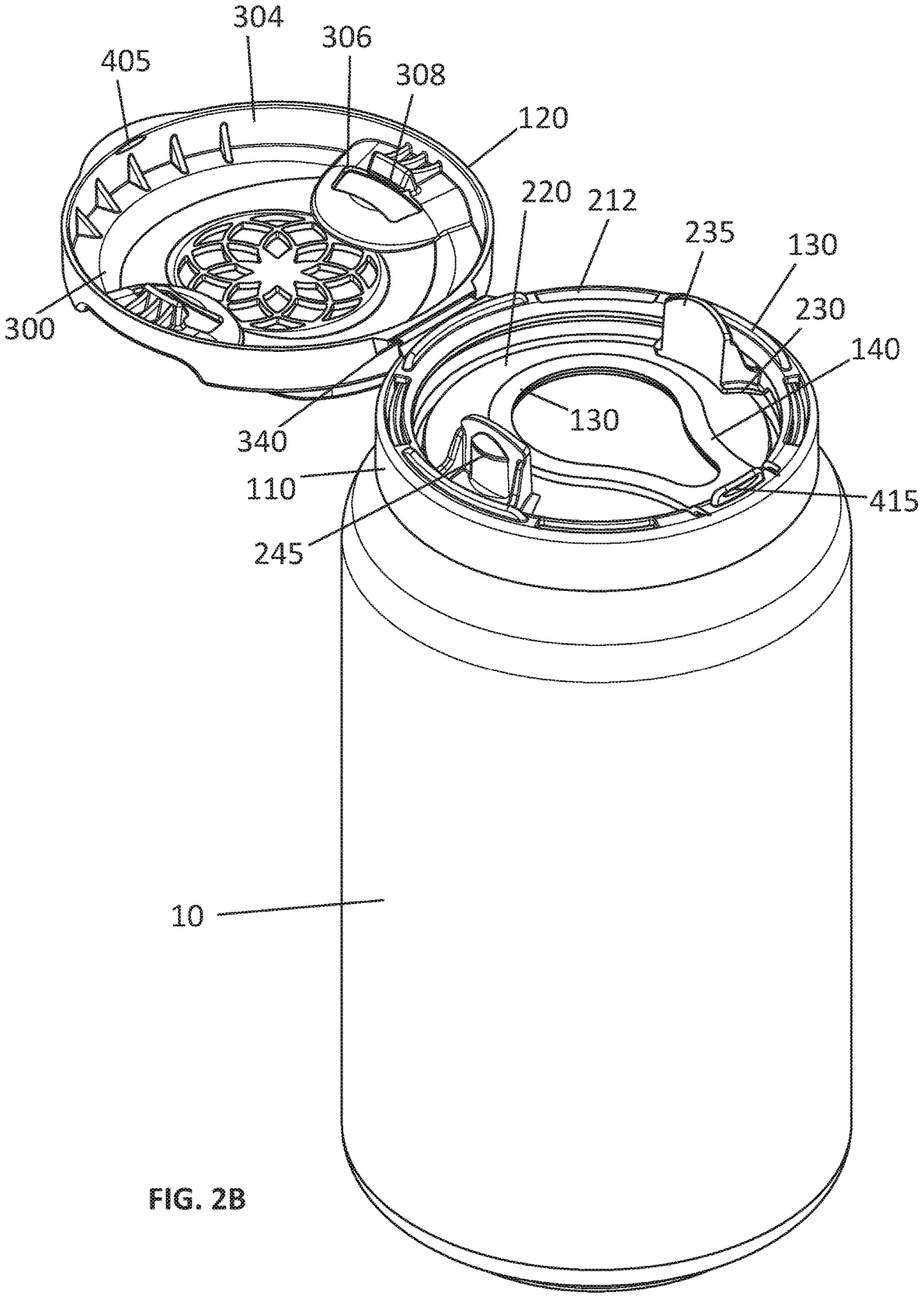
FIG. 2B is a perspective view of a closure mechanism secured to a can and illustrated in an open configuration in accordance with one or more embodiments of the present invention.
Figure 3:
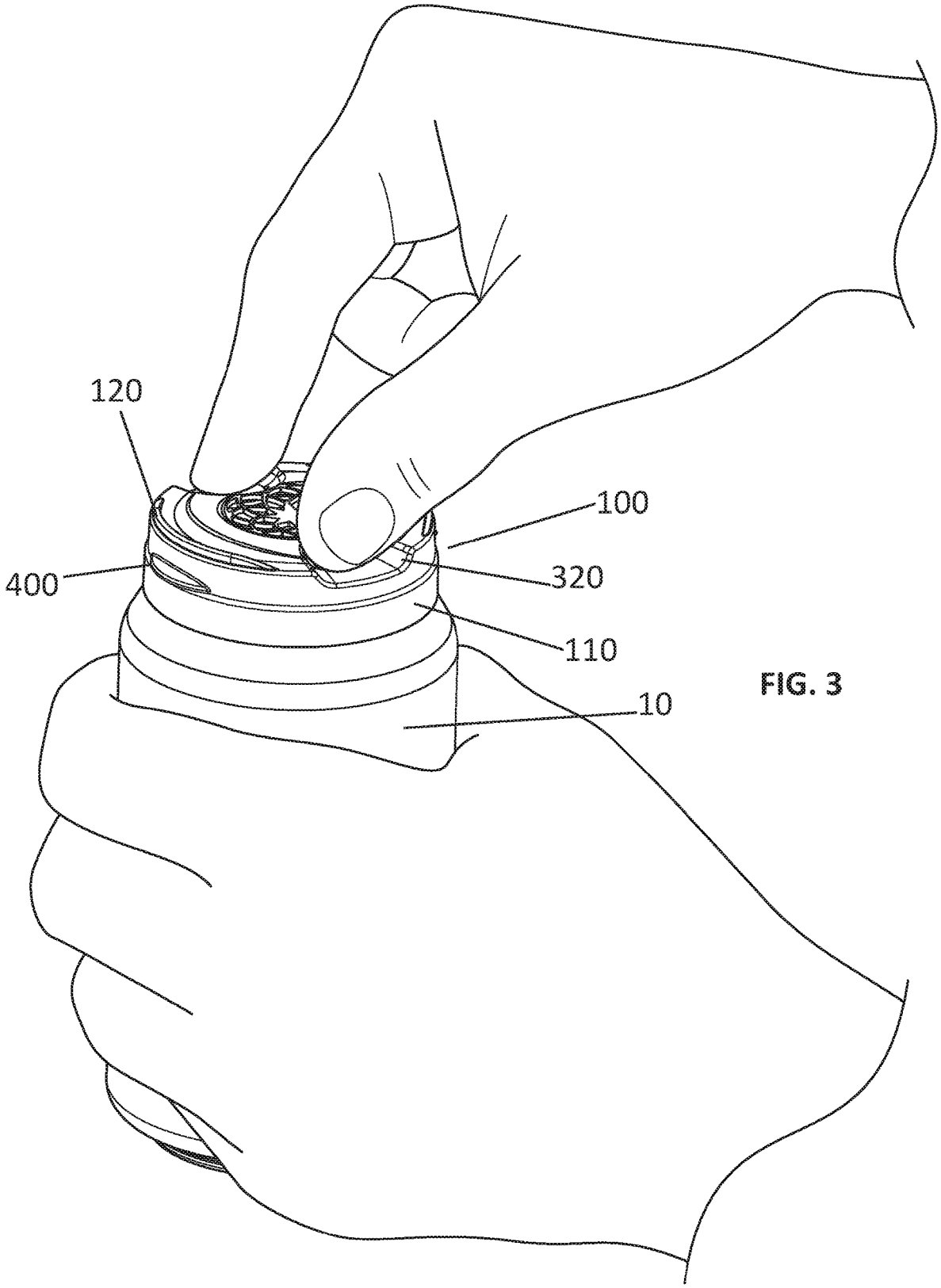
FIG. 3 is a perspective view of a closure mechanism secured to a can and illustrating the manual manipulative locking mechanism configured in accordance with one or more embodiments of the present invention.
Figure 4:
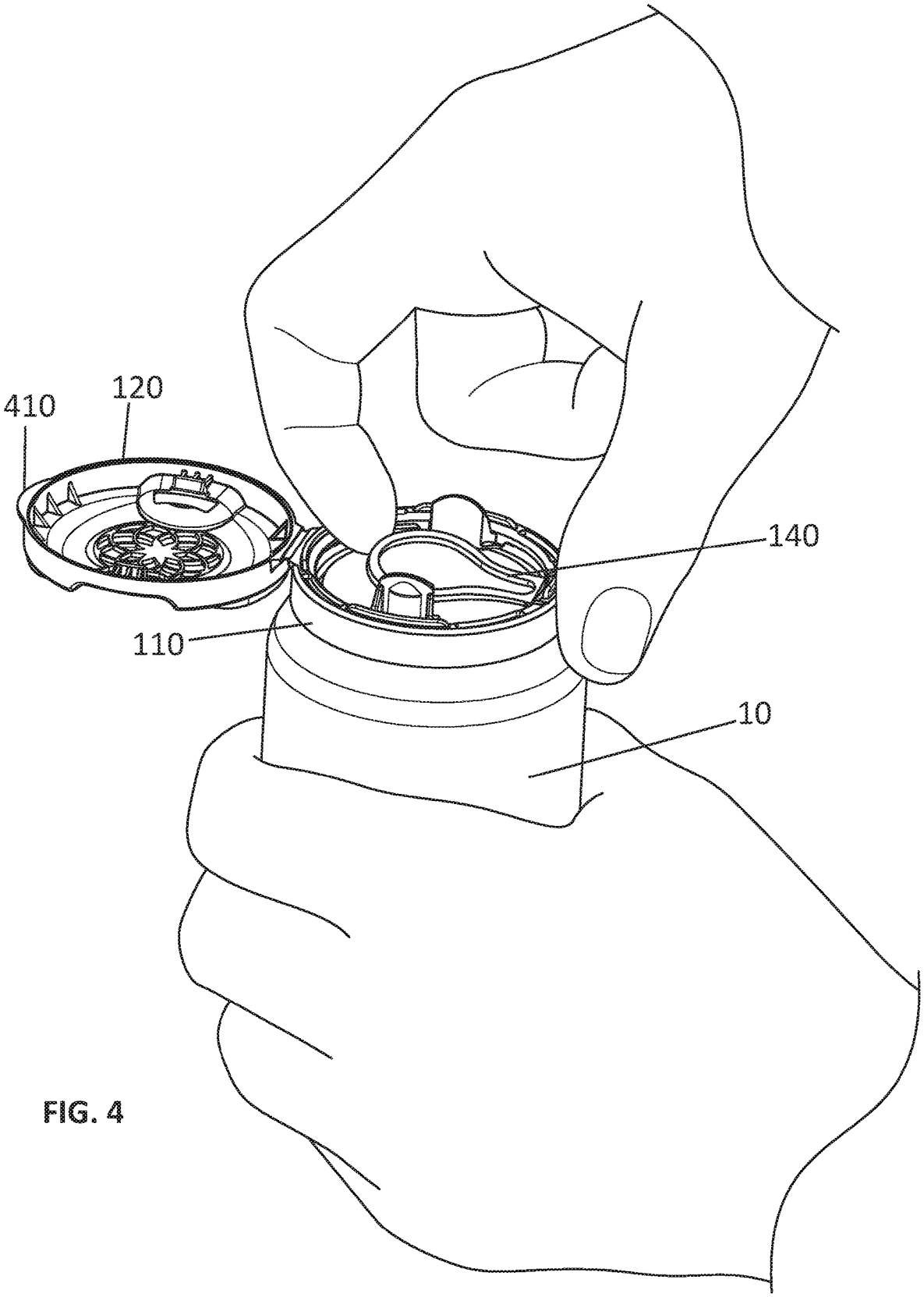
FIG. 4 is a perspective view of a closure mechanism illustrating the pull tab in accordance with one or more embodiments of the present invention.
Figure 5:
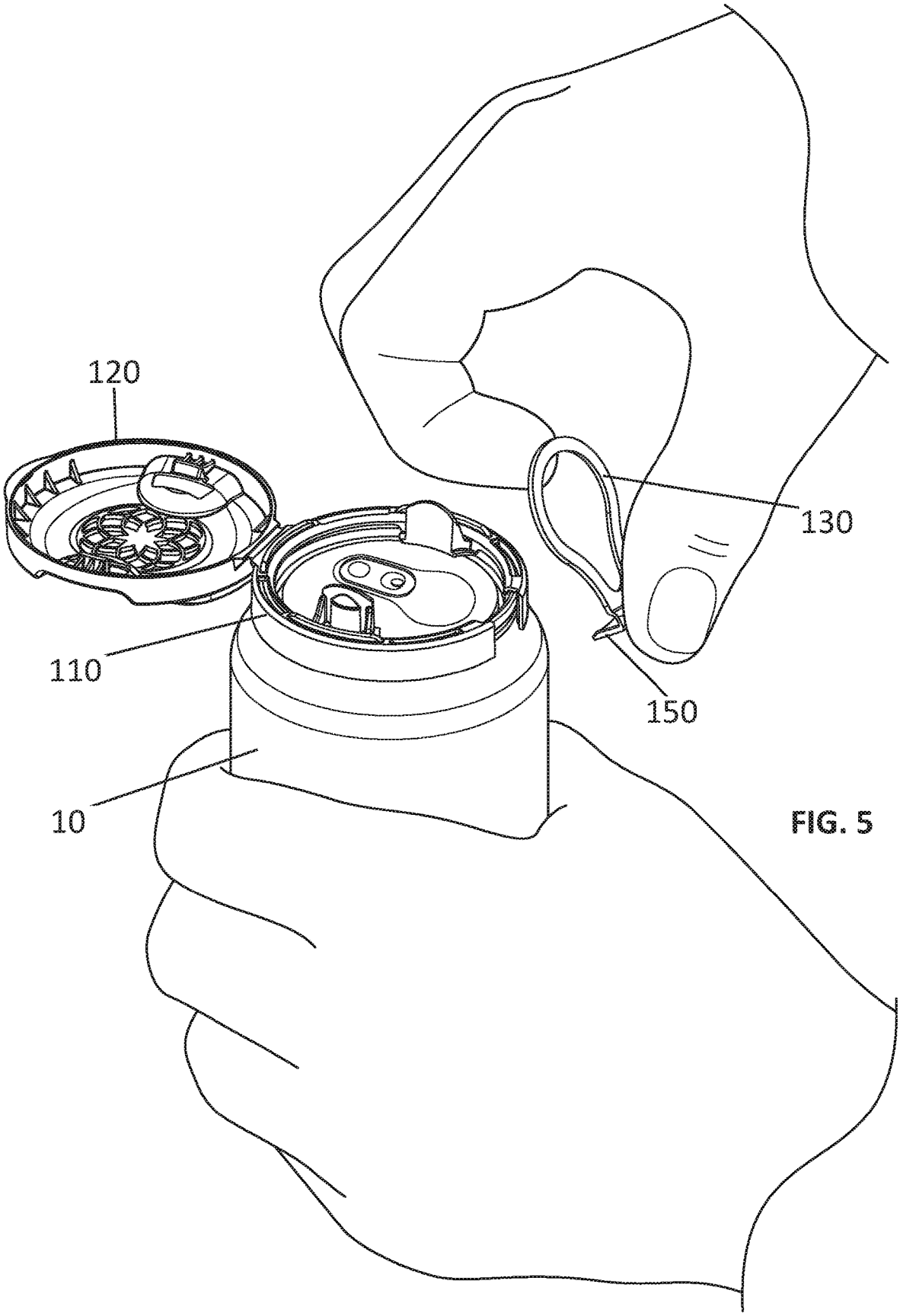
FIG. 5 is a perspective view of a closure mechanism illustrating the removal of the pull tab in accordance with one or more embodiments of the present invention.
Figure 6:
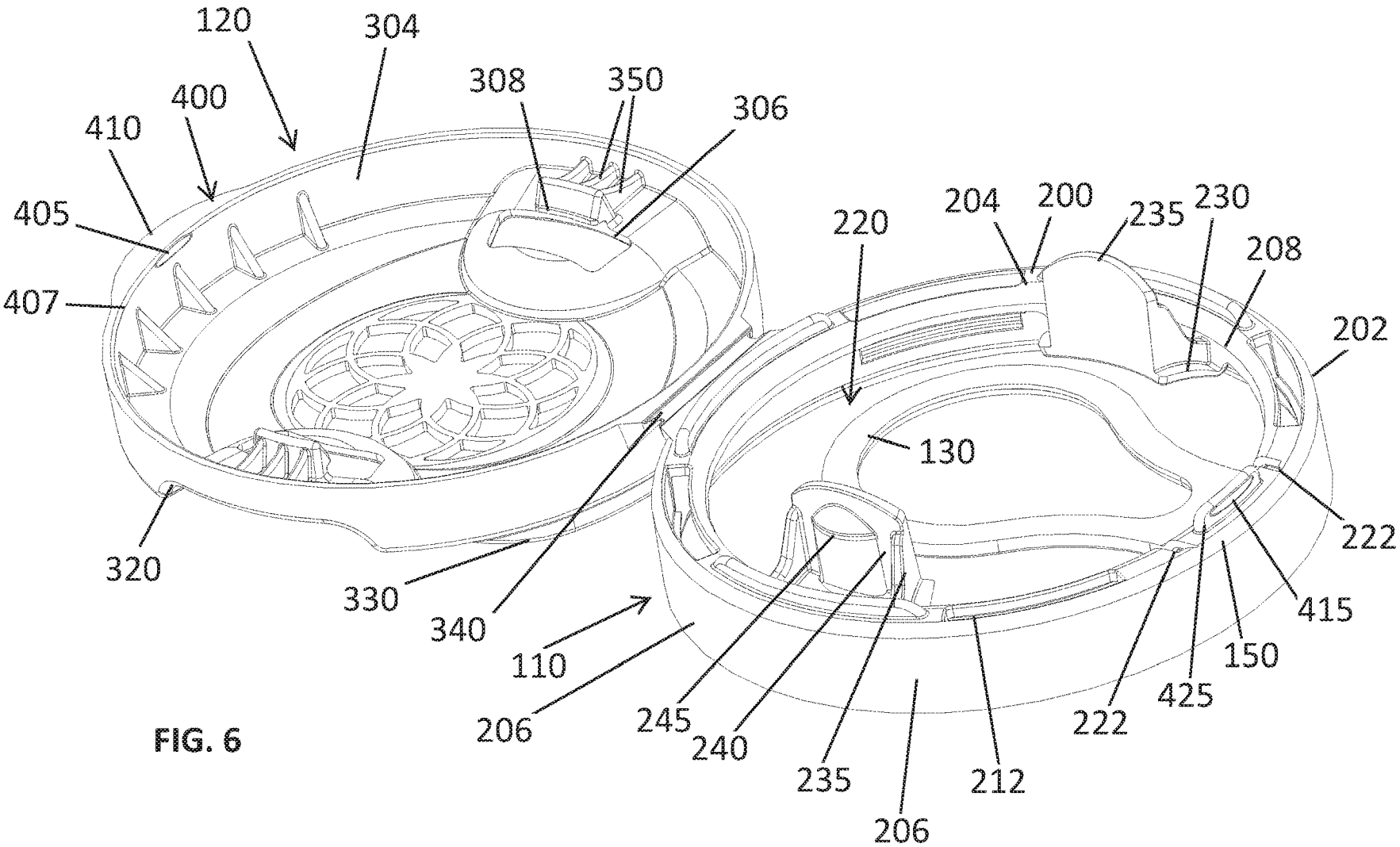
FIG. 6 is a perspective view of the closure mechanism in an open configuration in accordance with one or more embodiments of the present invention.
Figure 7:
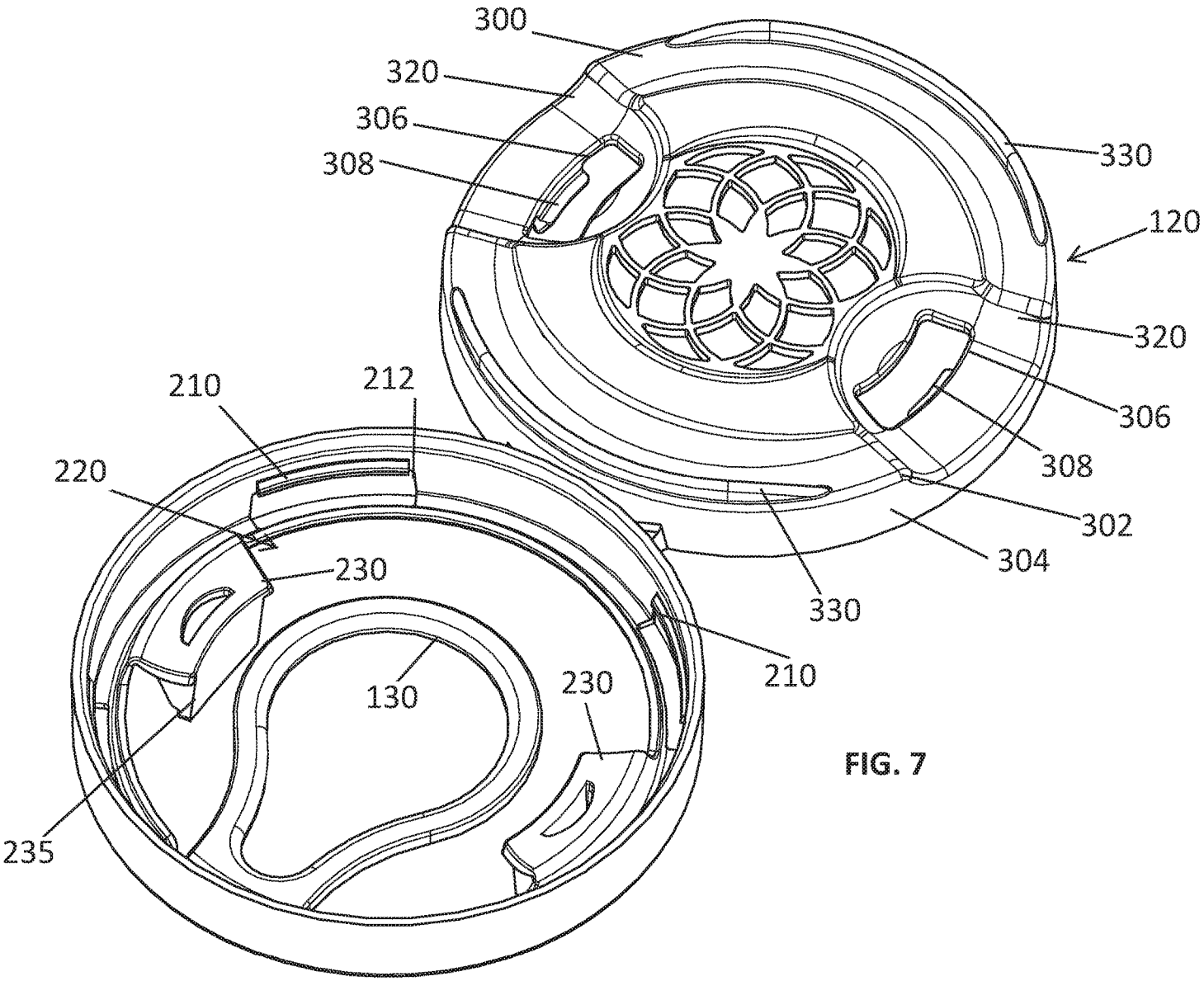
FIG. 7 is a perspective view of the closure mechanism in an open configuration taken from underneath the closure mechanism.
Figure 8:
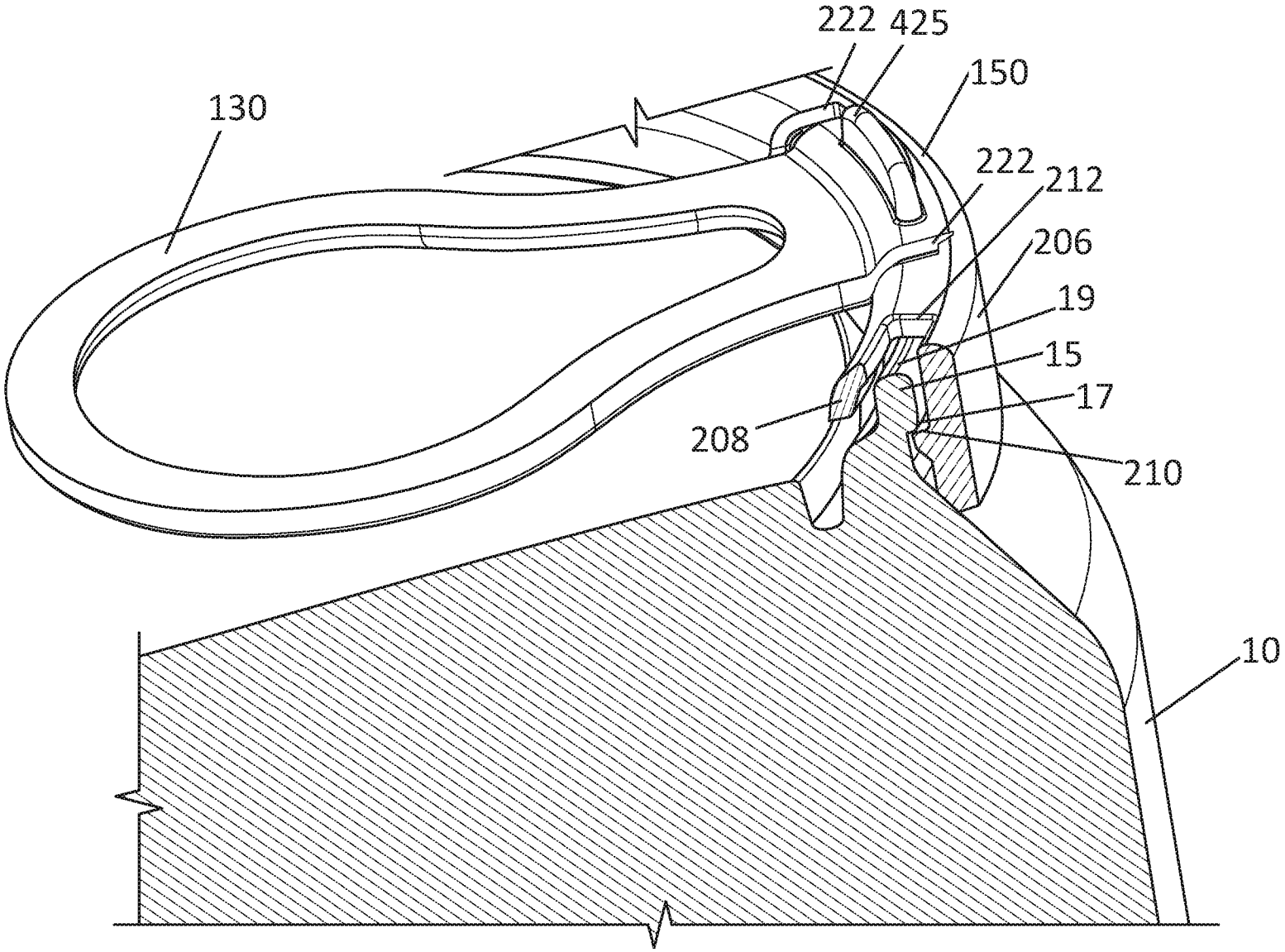
FIG. 8 is an enlarged section view illustrating the closure mechanism secured to a can in accordance with one or more embodiments of the present invention.
Figure 9:
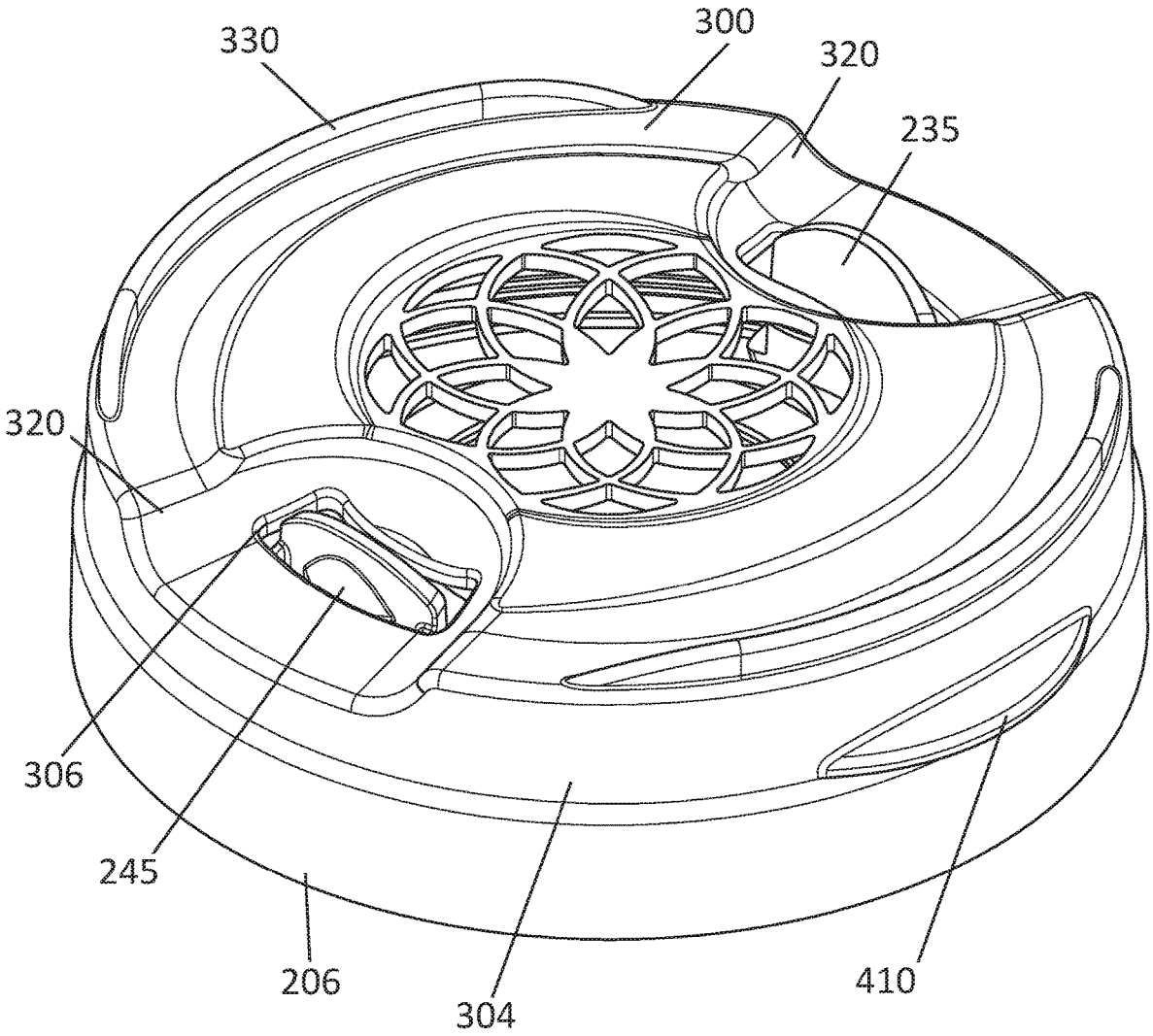
FIG. 9 is a perspective view of the closure mechanism in a closed configuration in accordance with one or more embodiments of the present invention.

While the invention is susceptible to embodiments in many different forms, there are shown in the drawings and will be described in detail herein the preferred embodiments of the present invention. It should be understood, however, that the present disclosure is to be considered an exemplification of the principles of the invention and is not intended to limit the spirit or scope of the invention of the embodiments illustrated.

Referring now to FIGS. 1 through 5 there is shown a typical can 10 that includes top end 15 that has a normal opening 20, in that it includes a tab 25 sealing the opening 20. A consumer simply applies an upward force to an end of the tab 25 to pierce the opening 20 and gain access to the contents of the can 10. However, there are instances in which the contents of the can are harmful to children. In these instances, it is desired to employ the invention which is a child resistant senior friendly closure mechanism 100, illustrated in FIG. 2.

The closure mechanism 100 has a base 110 and a cover 120 that when in a closed configuration (illustrated in FIG. 2A) prevents easy access to the top of the can and more importantly the tab 25. However, the cover 120 can be moved by a user to an open configuration (illustrated in FIG. 2B) using a specifically designed child resistant/senior friendly opening mechanism 130 (illustrated in FIG. 3). In the open configuration the user has access to a removable pull ring 140 connected to the base 110 (illustrated in FIG. 4), which when removed splits or breaks a portion 150 of the base 110 off from the remaining portion 155 (illustrated in FIG. 5). Once the base 110 is broken the user can pull off the closure mechanism 100 and thus gain access to the top of the can (as illustrated in FIG. 1).

Referring now also to FIGS. 6-9, the base 110 of the closure mechanism 100 is designed to lock onto the top 15 of the can 10. The base 110 includes an annular ring 200 defined with an outer peripheral edge 202 and an inner peripheral edge 204. The annular ring 200 includes an outside base skirt 206 extending downwardly from the outer peripheral edge 202 and includes an inside base skirt 208 extending downwardly from the inner peripheral edge 204. The outside base skirt 206 includes inwardly extending tabs 210 configured to grip under a ledge 17 that is created around a peripheral of the top 15 of the can 20. The outside and inside base skirts are configured away from each other a predetermined distance such that the upper lip 19 of the can 10 is capable of fitting between the two skirts. The annular ring 200 may further include slots 212 aligned over the inwardly extending tabs 210 to allow deflection of the annular ring if a user tries to tamper with the base 110.

The base 110 further includes a pull ring 130 secured to a front portion 150 of the base 110 and extending within a general opened space 220 of the annular ring 200. The annular ring 200 includes a notch 222 on either side of the front portion 150 such that when the pull ring is pulled the notches 222 assist in allowing a user to break off the front portion 150 from the base 110. As noted above, once the front portion 150 of the base 110 is removed, the user can peel away the rest of the base 110 from the top of the can 10.

The base 110 further includes a pair of arms 230 extending from the inside base skirt 208 inwardly towards the center and which are diametrically opposed to each other. Each arm 230 includes a flange 235 extending upwardly above the annular ring 200. An outside surface 240 (surface facing towards the inside base skirt 208) of the flange 235 includes a projection tab 245.

The flanges 235 are configured to be resiliently connected to the base 110, which, as explained in detail below, allows the user to unlock the opening mechanism 130 to move from the cover form the closed configuration to the open configuration as well as locks the cover to the base 110 when closed.

The cover 120 of the closure mechanism 100 includes a top surface 300 terminating at a top peripheral edge 302 to a top skirt 304 that extends downwardly. Corresponding to the pair of flanges 235 are a pair of slots 306 defined in the top surface 300. Each slot 306 includes a projection member 308 positioned on one side of the slot 306 to act in concert with the projection tab 245 on the flange 235 defined on the base 110. When the cover 120 is moved to the closed position, the cover 120 is moved over the base 110, such that the flanges 235 slide though the slots 306, when closed, the projection tabs 245 click or slide past the projection members 308. This temporarily locks the cover onto the base. The temporary lock can be released by pinching the flanges 235 towards each other until the projection tabs 245 slide past the projection members 308 and the cover can be pivoted upwardly to an open configuration.

In addition, the top surface 300 of the cover 120 can have a grooved or indented surface region 320 around each slot to provide for an additional clearance for the user's fingers to grasp the flanges 235. Furthermore, the top surface 300 of the cover 120 can further include raised guards 330 curved along the top peripheral edge 302 between the slots 306.

The cover 120 and base 110 are most likely hinged by a living hinge 340 positioned along an edge 345 of the two components.

From the underside of the cover 120, each projection member 308 may be reinforced with a series of projection ribs 350 to ensure the projection member 308 does not lose its stiffness.

Lastly, to help further facilitate the child safety locking of the cover and base, a secondary function must be incorporated along with the pinching of the flanges 235. This is accomplished by a front end click lock 400, which includes a catch 405 positioned on an edge 407 of the skirt 304 defined on the cover 120 working in concert with a bead 415 positioned on a boss 425 extending from the annular ring 200, preferably positioned between the two notches 222. The front end click lock 400 can be opened by a user applying an upward force to the cover to overcome the frictionally force of catch/bead. The user can apply the force to a lip 410 on the cover 120.

As defined the closure mechanism has a base that is fitted over and onto the can and which locks onto the can. The mechanism further includes a cover that closes and locks onto the base preventing access to the top of the can. The closure mechanism further includes a unlocking mechanism that a user can use to move the cover from a closed configuration to an open configuration with a finger pinch and lifting manipulation. Once the cover is in the open configuration the user can remove the base from the can to gain access.

Figure 10:
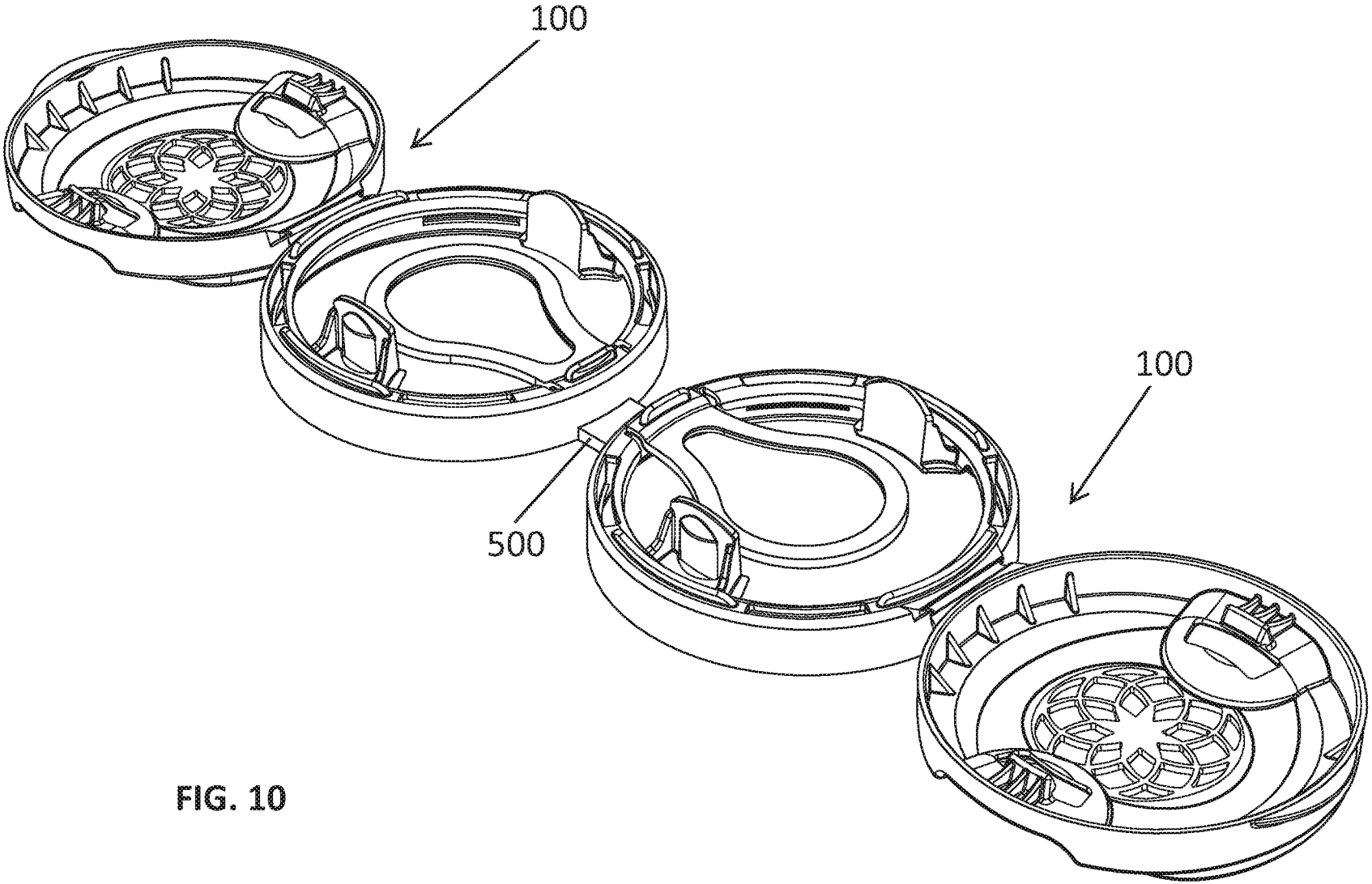
FIG. 10 is a perspective view of a closure mechanism a plurality configuration showing two closure mechanisms.
Figure 11:
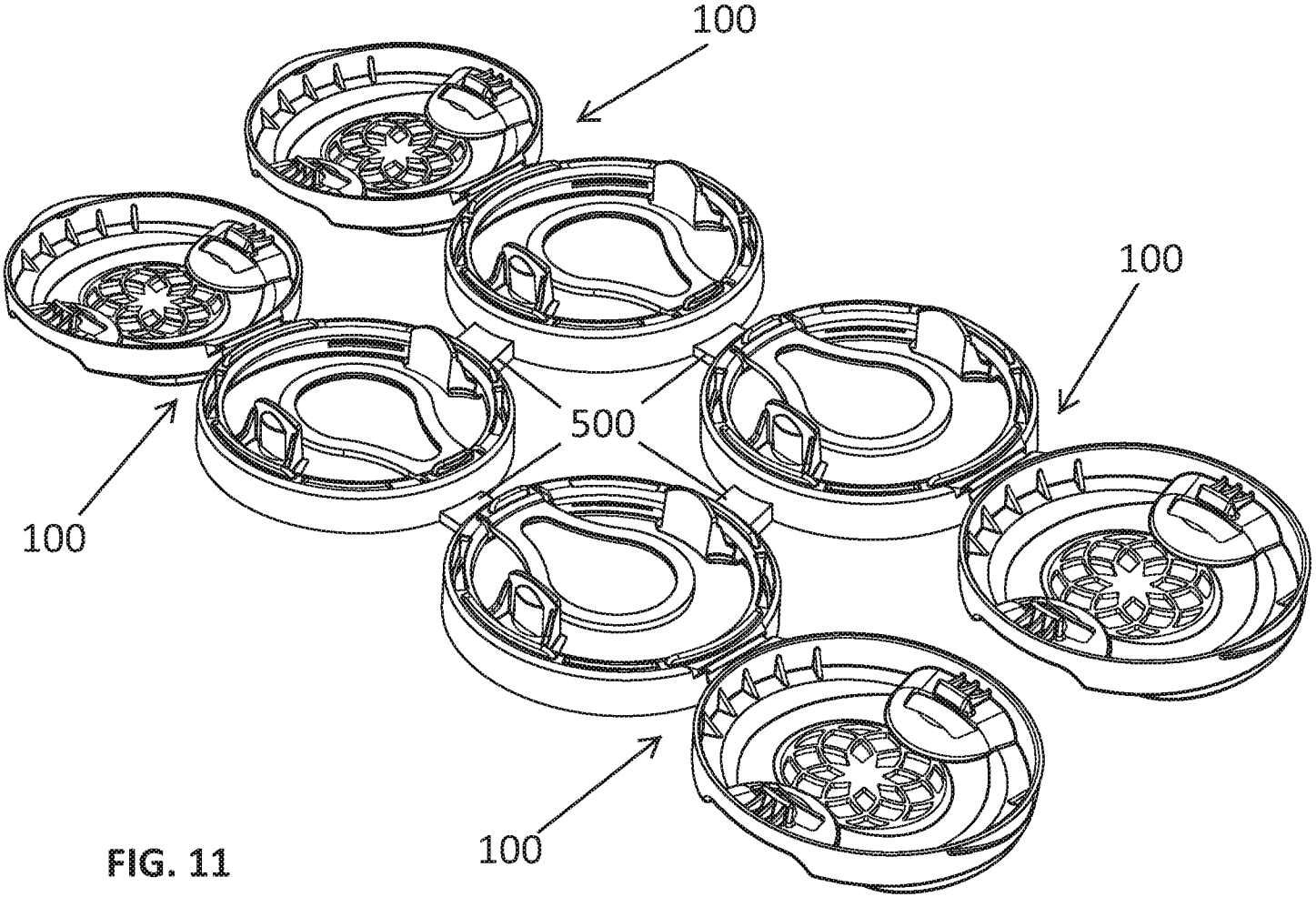
FIG. 11 is a perspective view of a closure mechanism a plurality configuration showing four closure mechanisms.
Figure 12:
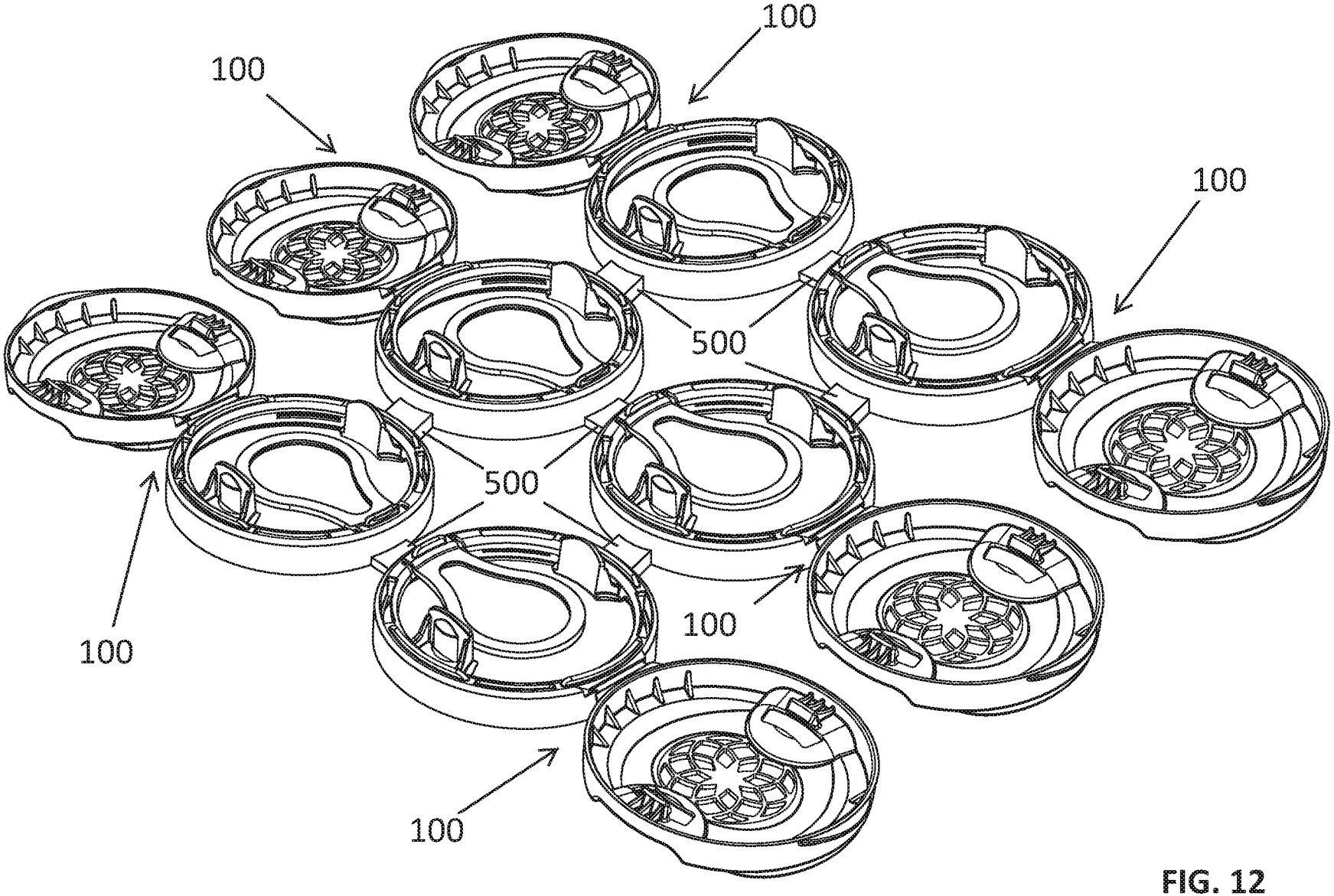
FIG. 12 is a perspective view of a closure mechanism a plurality configuration showing six closure mechanisms.
Figure 13A:
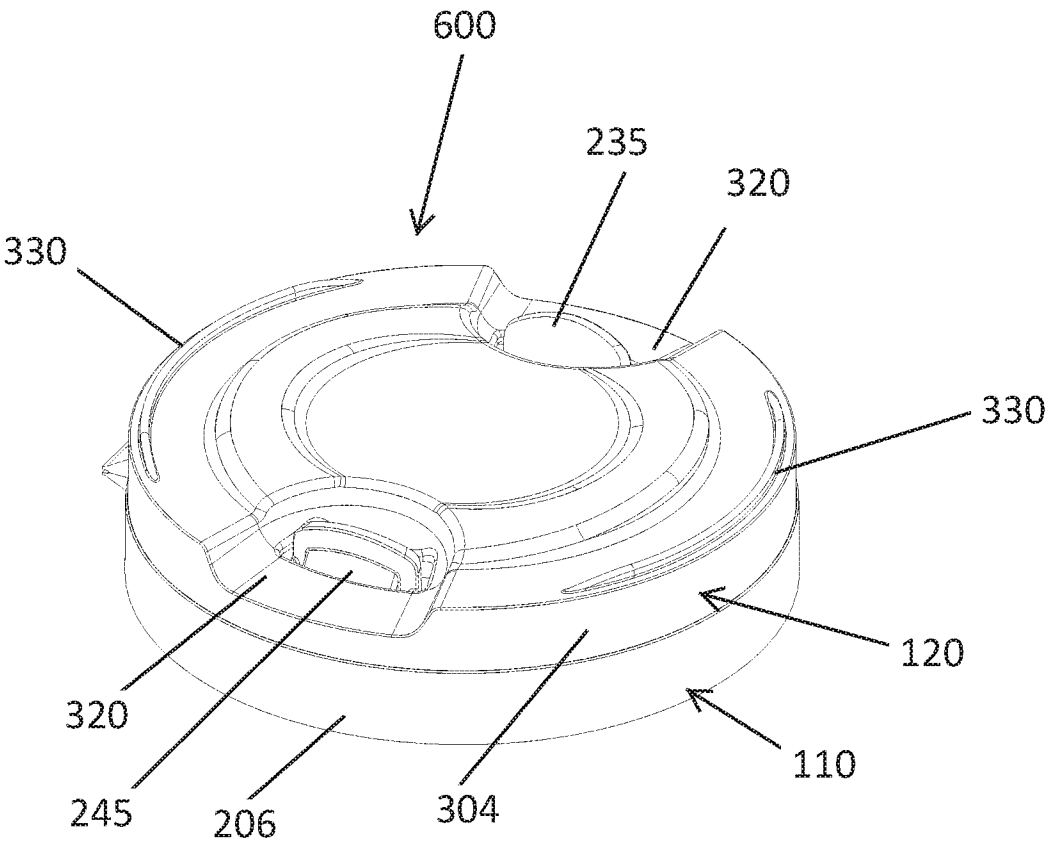
FIG. 13A is a perspective view of another closure mechanism in a closed configuration in accordance with one or more embodiments of the present invention.
Figure 13B:
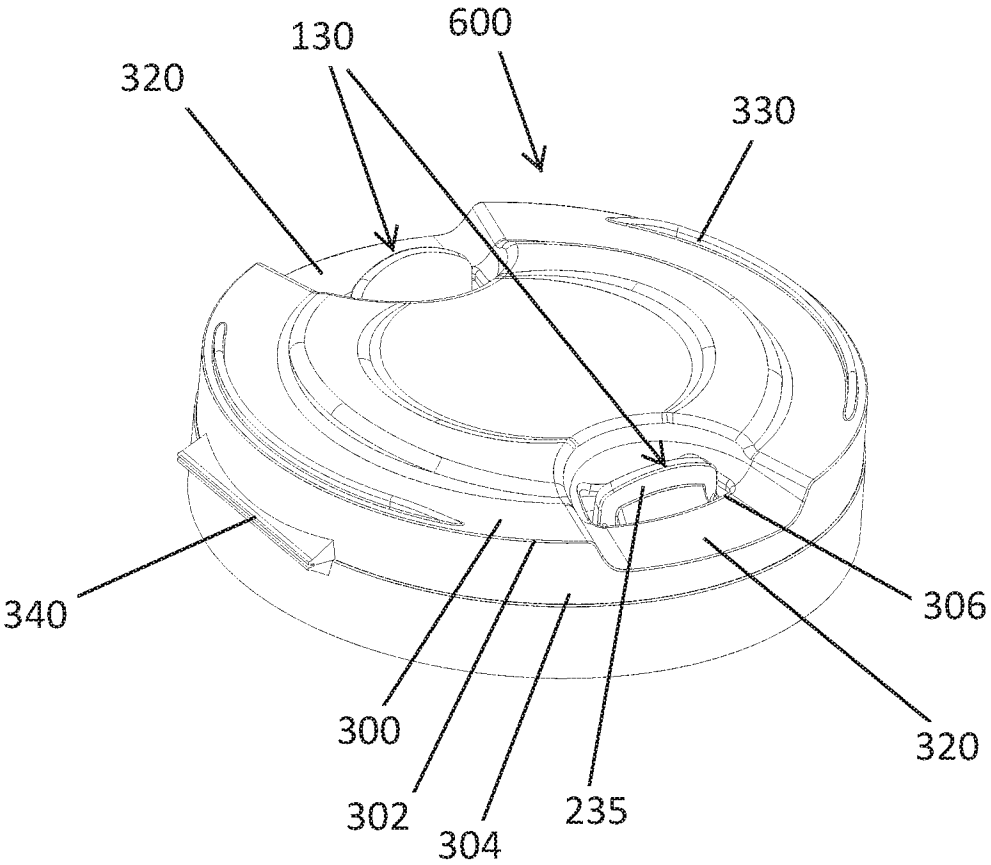
FIG. 13B is another perspective view of the closure mechanism from FIG. 13A.
Figure 14A:
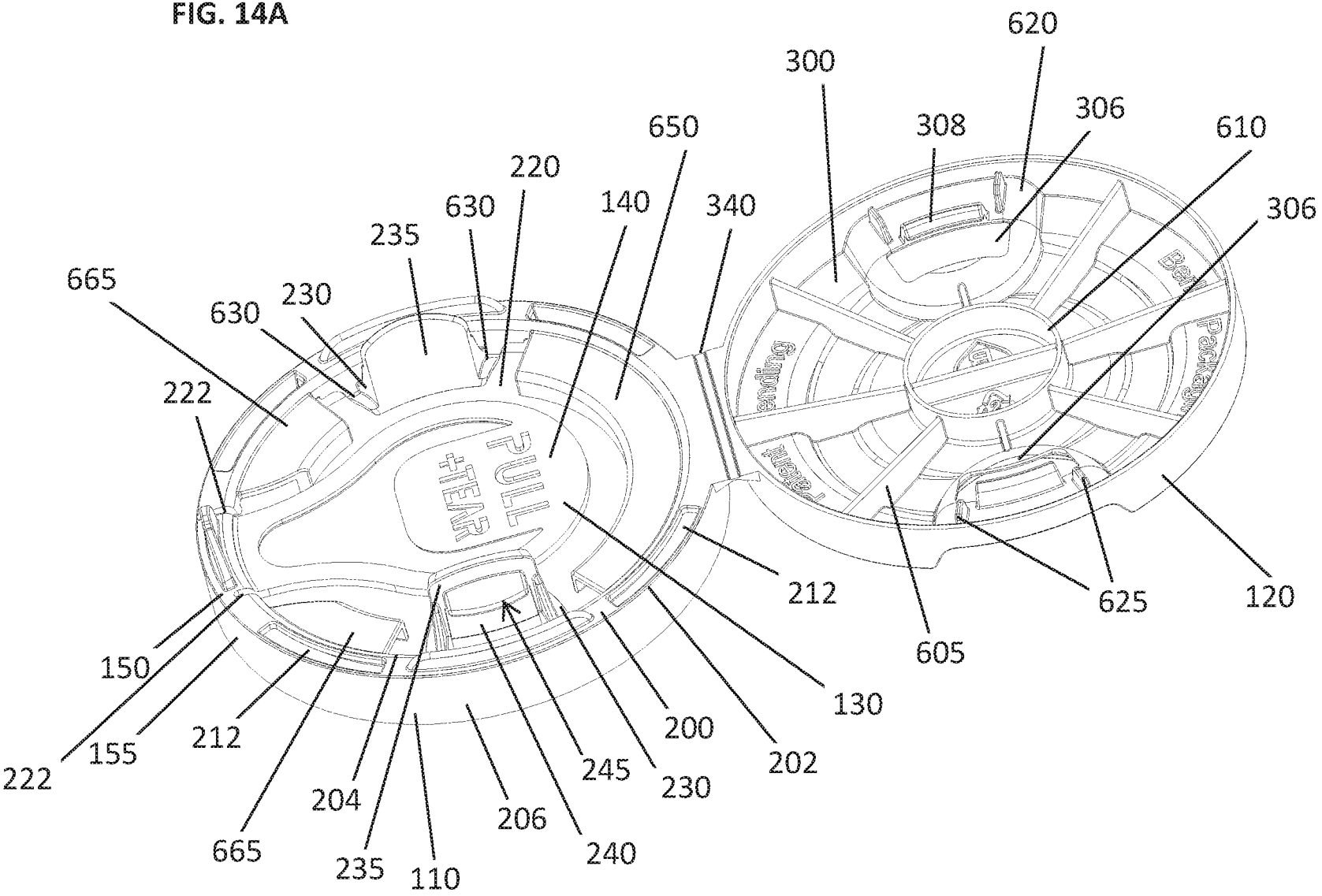
FIG. 14A is a perspective view of the closure mechanism in an open configuration in accordance with one or more embodiments of the present invention.
Figure 14B:
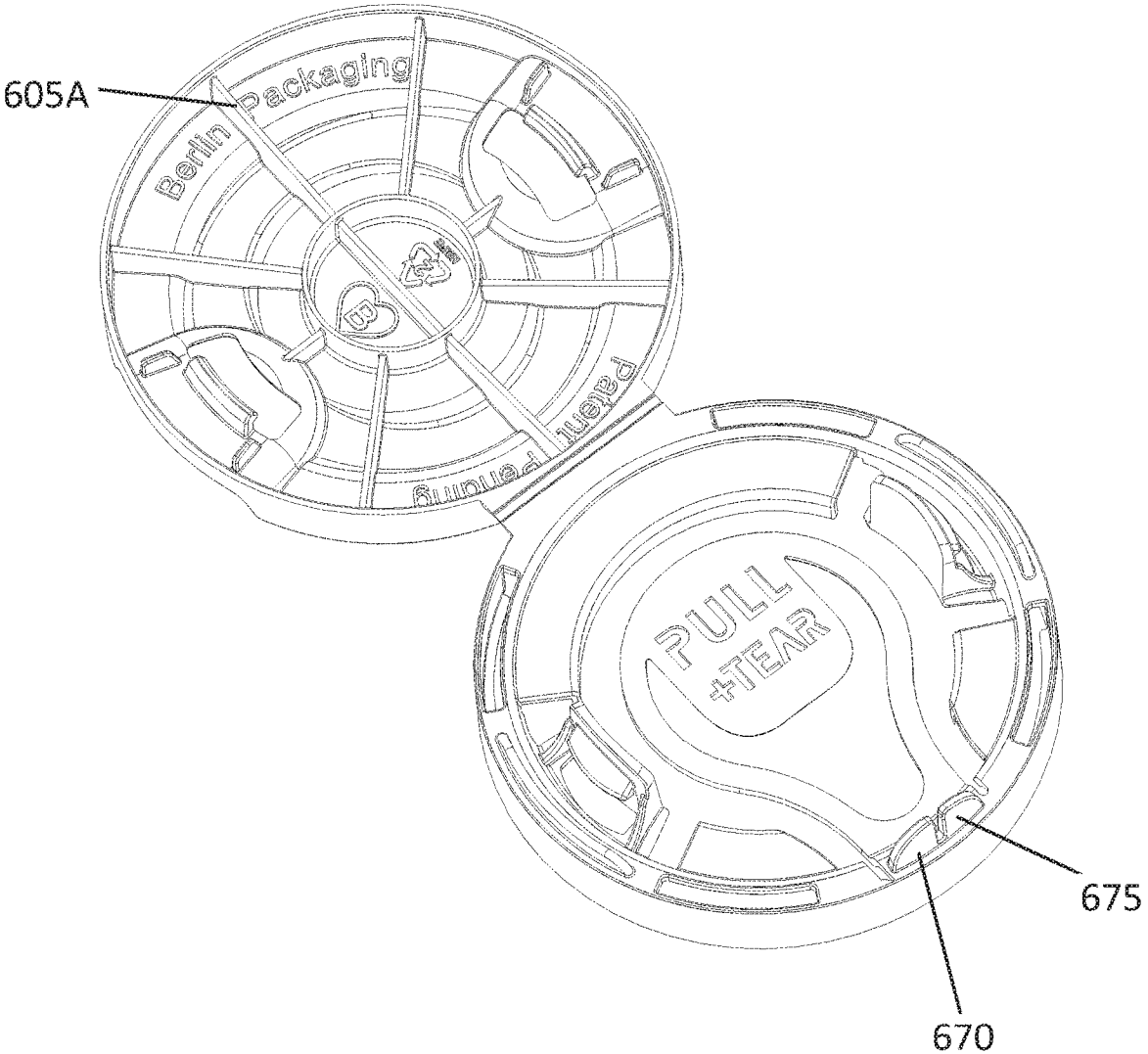
FIG. 14B is another perspective view of the closure mechanism from FIG. 14A also in an open configuration.
Figure 14C:
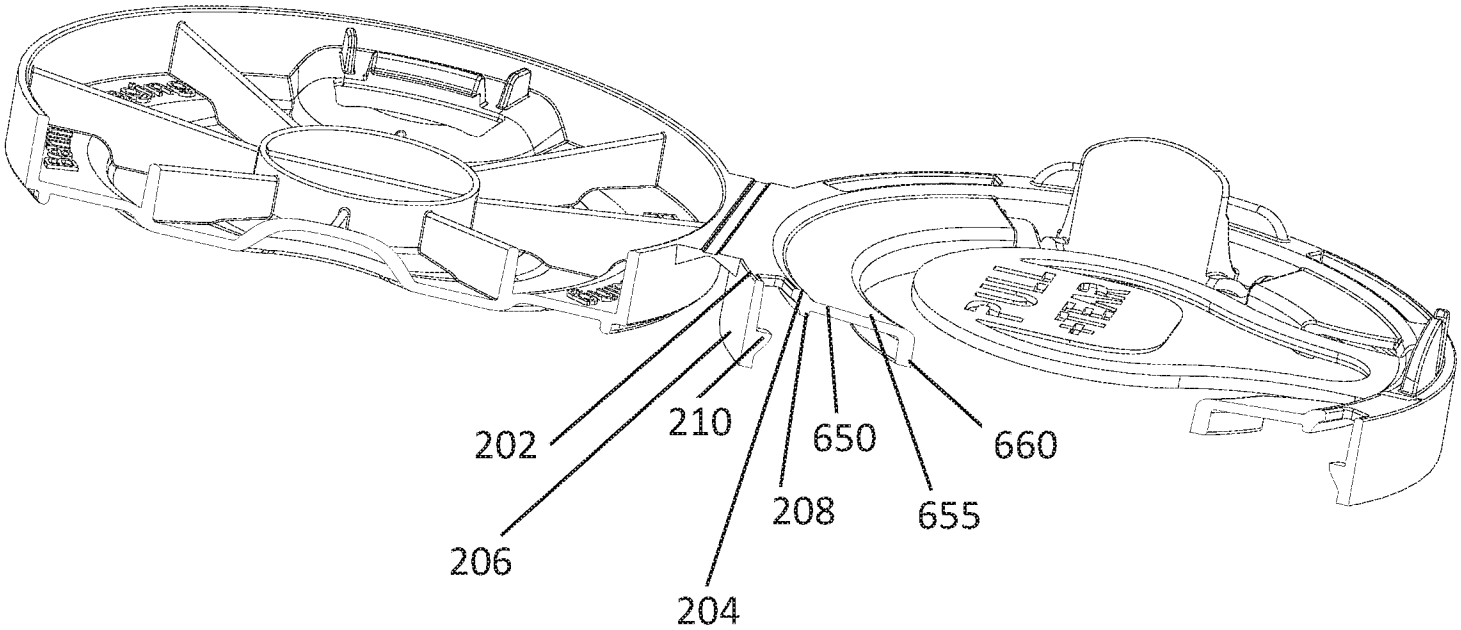
FIG. 14C is a sectional view of the closure mechanism from FIG. 14A.
Figure 15:
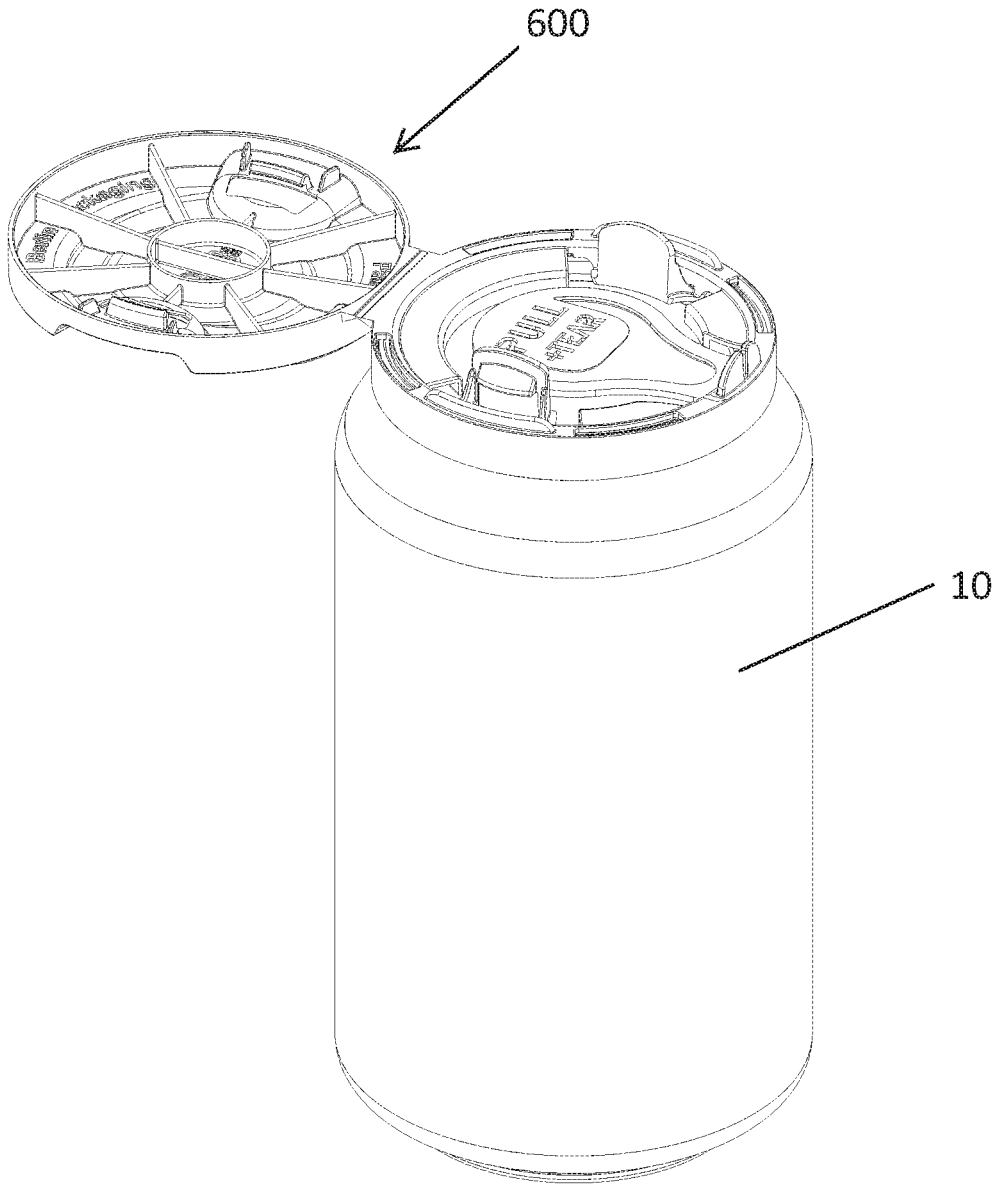
FIG. 15 is a perspective view of the closure mechanism from FIG. 13A illustrated in an open configures on a can.

In various embodiments, the closure mechanism 100 can be a single unit or sold and packaged in various pairs depending on how the user want to sell the cans. For example, FIG. 10 shows a pair of closure mechanisms 100 paired together by a breakable frangible clip 500; FIG. 11 shows four closure mechanisms 100 held together by four breakable frangible clips 500; and FIG. 12 shows six closure mechanisms 100 held together by seven breakable frangible clips 500.

Referring now to an alternative embodiment in FIGS. 13A-16D; similar components are general referenced in similar previous element numbers.

Figure 16A:
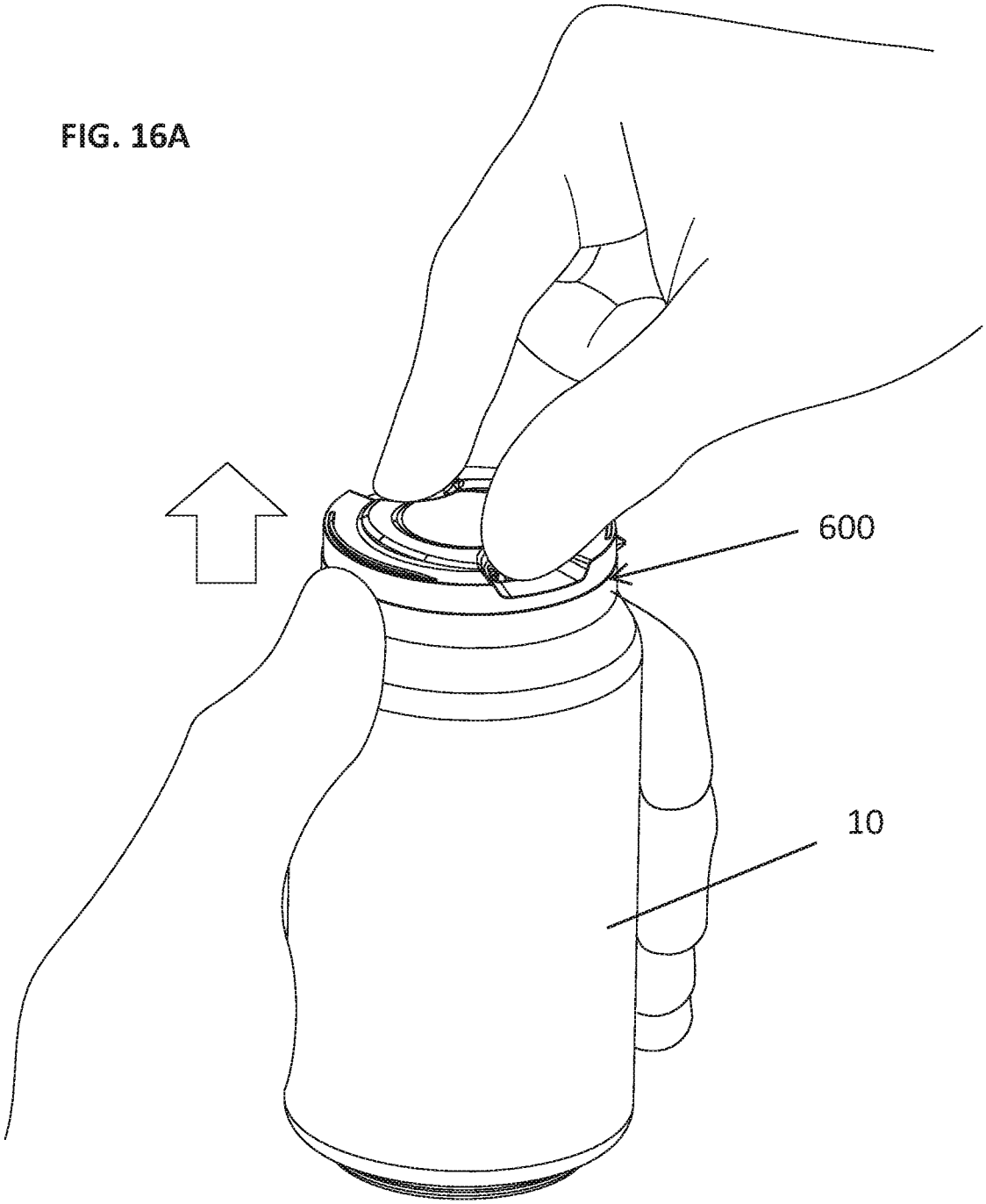
FIGS. 16A-16D are perspective view of the closure mechanism from FIG. 13A illustrated as it is removed from a can.
Figure 16B:
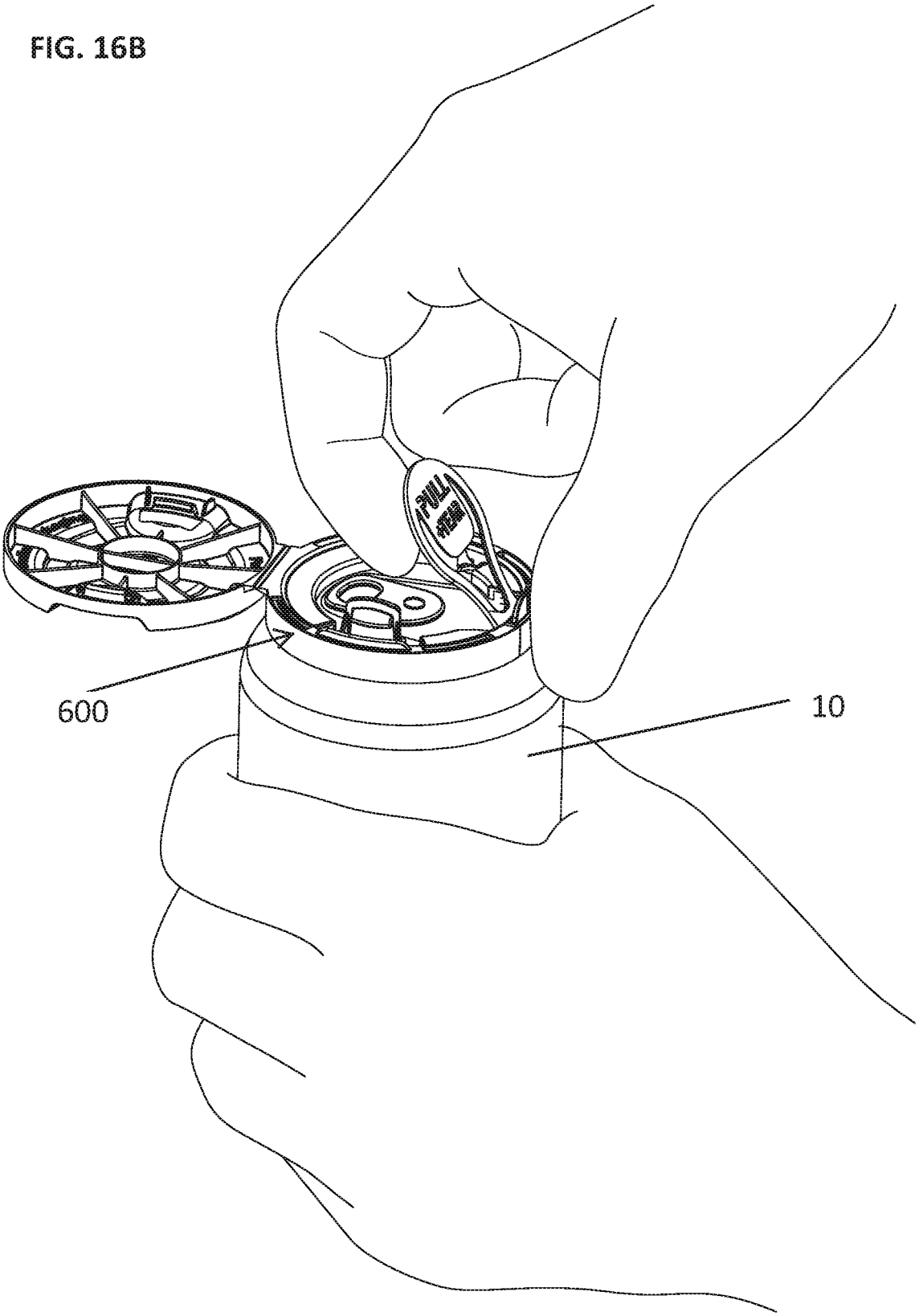
Figure 16C:
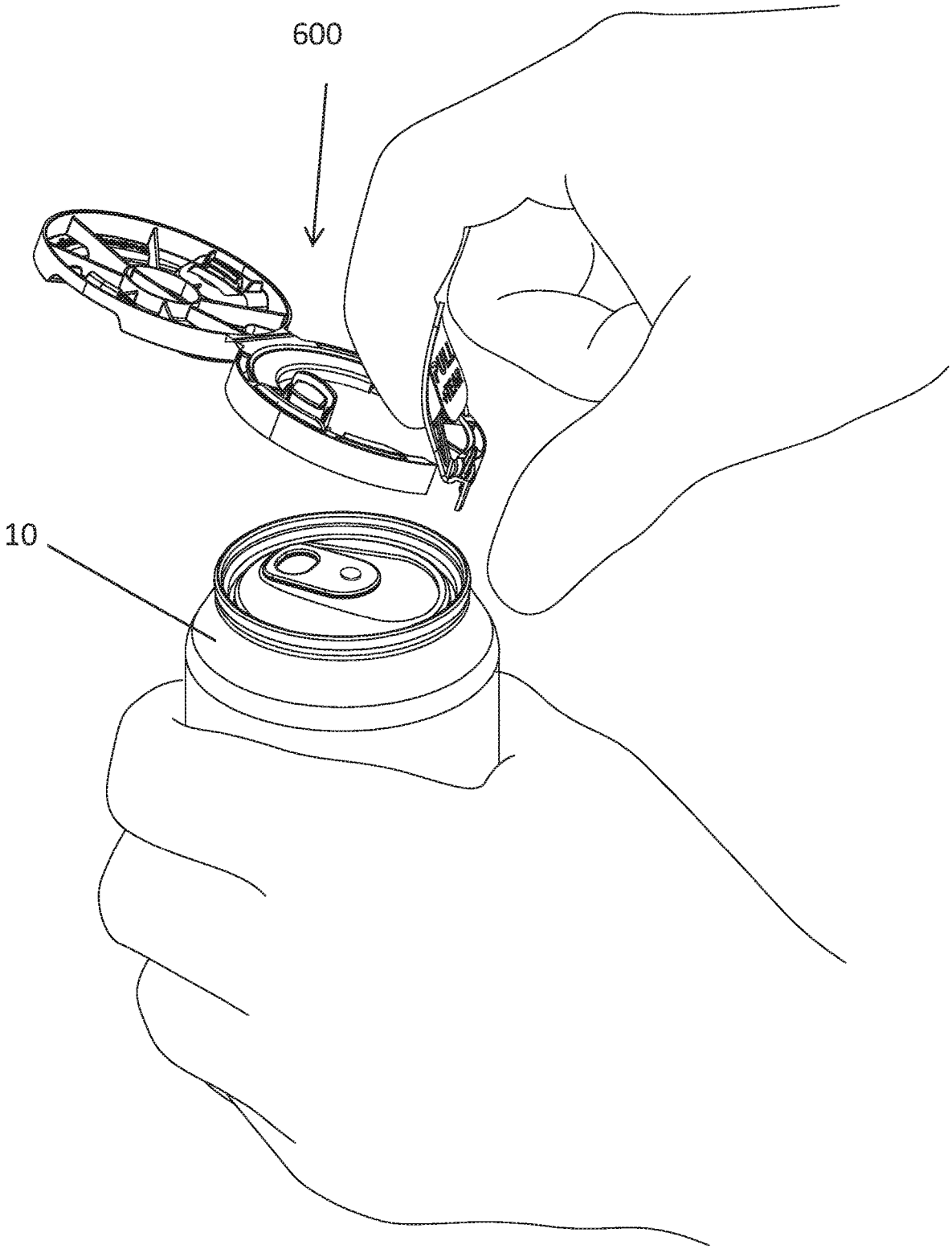
Figure 16D:
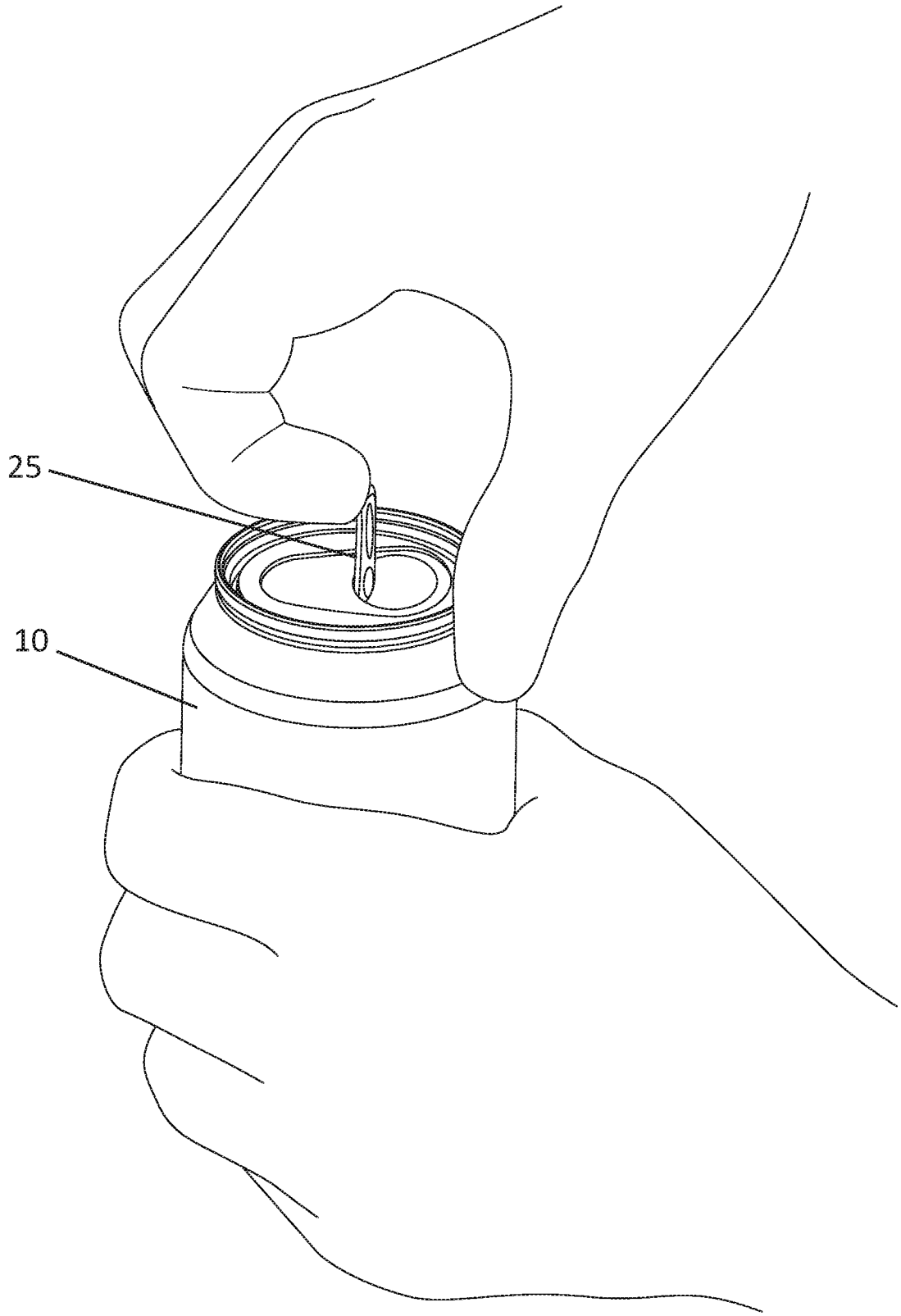

The closure mechanism 600 has a base 110 and a cover 120 that when in a closed configuration (illustrated in FIGS. 13A and 13B) prevents easy access to the top of the can and more importantly the tab 25. However, the cover 120 can be moved by a user to an open configuration (illustrated in FIG. 14A) using a specifically designed child resistant/senior friendly opening mechanism 130 (illustrated in FIG. 13A). In the open configuration the user has access to a removable pull ring 140 connected to the base 110 (illustrated in FIG. 14A), which when removed, splits or breaks a portion 150 of the base 110 off from the remaining portion 155 (illustrated in FIG. 16C). Once the base 110 is broken the user can pull off the closure mechanism 100 and thus gain access to the top of the can (as illustrated in FIG. 16D).

Referring now also to FIGS. 13A-16D, the base 110 of the closure mechanism 600 is designed to lock onto the top 15 of the can 10. The base 110 includes an annular ring 200 defined with an outer peripheral edge 202 and an inner peripheral edge 204. The annular ring 200 includes an outside base skirt 206 extending downwardly from the outer peripheral edge 202 and includes an inside base skirt 208 extending downwardly from the inner peripheral edge 204. The outside base skirt 206 includes inwardly extending tabs 210 configured to grip under a ledge 17 that is created around a peripheral of the top 15 of the can 20. The outside and inside base skirts are configured away from each other a predetermined distance such that the upper lip 19 of the can 10 is capable of fitting between the two skirts. The annular ring 200 may further include slots 212 aligned over the inwardly extending tabs 210 to allow deflection of the annular ring if a user tries to tamper with the base 110.

The base 110 further includes a pull ring 140 secured to a front portion 150 of the base 110 and extending within a general opened space 220 of the annular ring 200. The annular ring 200 includes a notch 222 on either side of the front portion 150 such that when the pull ring is pulled the notches 222 assist in allowing a user to break off the front portion 150 from the base 110. As noted above, once the front portion 150 of the base 110 is removed or split from the base 110, the user can peel away the rest of the base 110 from the top of the can 10.

The base 110 further includes a pair of arms 230 extending from the inside base skirt 208 inwardly towards the center and which are diametrically opposed to each other. Each arm 230 includes a flange 235 extending upwardly above the annular ring 200. An outside surface 240 (surface facing towards the inside base skirt 208) of the flange 235 includes a projection tab 245.

The flanges 235 are configured to be resiliently connected to the base 110, which, as explained in detail below, allows the user to unlock the opening mechanism 130 to move from the cover form the closed configuration to the open configuration as well as locks the cover to the base 110 when closed.

The cover 120 of the closure mechanism 100 includes a top surface 300 terminating at a top peripheral edge 302 to a top skirt 304 that extends downwardly. Corresponding to the pair of flanges 235 are a pair of slots 306 defined in the top surface 300. Each slot 306 includes a projection member 308 positioned on one side of the slot 306 to act in concert with the projection tab 245 on the flange 235 defined on the base 110. When the cover 120 is moved to the closed position, the cover 120 is moved over the base 110, such that the flanges 235 slide though the slots 306, when closed, the projection tabs 245 click or slide past the projection members 308. This temporarily locks the cover onto the base. The temporary lock can be released by pinching the flanges 235 towards each other until the projection tabs 245 slide past the projection members 308 and the cover can be pivoted upwardly to an open configuration.

In addition, the top surface 300 of the cover 120 can have a grooved or indented surface region 320 around each slot to provide for an additional clearance for the user's fingers to grasp the flanges 235. Furthermore, the top surface 300 of the cover 120 can further include raised guards 330 curved along the top peripheral edge 302 between the slots 306.

The cover 120 and base 110 are most likely hinged by a living hinge 340 positioned along an edge 345 of the two components.

From the underside of the cover 120, the top surface 300 may be reinforced with a series of radial crosspieces 605 outwardly positioned form a central cross ring 610. In addition, each of the underside surfaces 620 defined below the indented surface regions 320 may be reinforced with a series of pair of projection ribs 625 which slide into slots 630 positioned on either side of the arm 230 maintaining the flanges 235. This ensures proper alignment and locking of the flanges 234 with the projection members 308.

In addition, to further prevent tampering, the base 200 includes extended arcuate members 650/665 which extend from the inner peripheral edge 204 below the top of the annual ring 200, extend radially inward to define an arcuate top surface 655 and terminate into a downward lip 660. The arcuate members are positioned towards the living hinge 340 between the annual ring 200 and the pull ring 140 and then a pair of arcuate members 665 are separate positioned between the arms 230 and the connection of the pull ring 140 and the base 150.

Lastly, to help further facilitate the child safety locking of the cover and base, a secondary function must be incorporated along with the pinching of the flanges 235. This is accomplished by a front-end frictional engagement 670, which includes an upwardly extending slot tab 675 that engages a one of the radial crosspieces 605A. 405 positioned on an edge 407 of the skirt 304 defined on the cover 120 working in concert with a bead 415 positioned on a boss 425 extending from the annular ring 200, preferably positioned between the two notches 222. The front end front-end frictional engagement 400 can be opened by a user applying an upward force to the cover to overcome the frictionally force.

From the foregoing and as mentioned above, it is observed that numerous variations and modifications may be effected without departing from the spirit and scope of the novel concept of the invention. It is to be understood that no limitation with respect to the embodiments illustrated herein is intended or should be inferred. It is intended to cover, by the appended drawings provided, all such modifications within the scope of the invention.

We claim:

1. A child resistant closure mechanism configured for use with a can having a ledge surrounding a top portion of the can and which contents of the can are accessible from the top portion when the can is opened, the closure mechanism comprising:

a base having a base skirt configured to secure to a ledge of the can, wherein the base further includes an annular ring having an outer peripheral edge and an inner peripheral edge to define a base surface there between, an inside base skirt extending downwardly from the inner peripheral edge and an outside base skirt extending downwardly from the outer peripheral edge, the outside base skirt having inwardly extending tabs configured to grip under the ledge of the can when the closure mechanism is secured onto the can;

an opening defined within the inside base skirt of the annular ring;

a cover hinged to the base along an end, the cover configurable into a closed configuration with the base to prevent access to the top portion of the can and moveable into an open configuration with the base; and a removable pull tab connected to a portion of the base and positioned within the opening defined by the inside base skirt, the removable pull tab accessible only when the cover is in the open configuration, a pair of frangible notches on either side of the portion of the base by the removable pull tab such that when the removable pull tab is pulled, a section of the base separates from the base such that the base is removable from the ledge of the can to provide access to the top portion of the can and thus the contents.

2. The child resistant closure mechanism of claim 1, where the base further includes arcuate members extending into the opening and separately positioned about the pull tab.

3. The child resistant closure mechanism of claim 2, wherein the pair of frangible notches are positioned on the base surface of the annular ring and on either side of the portion of the base by the removable pull tab.

4. The child resistant closure mechanism of claim 2, wherein the annular ring further includes arcuate slots on the base surface adjacent the inwardly extending tabs configured to permit deflection of the annular ring and prevent tampering with the base.

5. The child resistant closure mechanism of claim 1, wherein the cover further includes:

a top surface terminating at a top peripheral edge to a downwardly extending top skirt, the top surface configured to cover a substantial portion of the top portion of the can when the cover and base are in the closed configuration.

6. The child resistant closure mechanism of claim 1 further comprising:

a manual manipulative locking mechanism configured to secure the cover and base in the closed configuration, the manual manipulative locking mechanism is configured for manual manipulation to release the cover from the base such that the cover may move into the open configuration.

7. The child resistant closure mechanism of claim 5, wherein the manual manipulative locking mechanism includes a pinch lock mechanism defined by including:

a pair of arms diametrically opposed to each other and each extending from the base skirt inwardly towards each other, each arm having a flange extending upwardly above the base, and a projection tab positioned on an outside surface of the flange;

a pair of slots separately corresponding to the pair of arms, each slot defined in a top surface on the cover to receive a flange when the cover and base are in the closed configuration, each slot includes a projection member configured to act in concert with the projection tab on the flange to secure the flanges and lock the cover and base in the closed configuration; and wherein each flange is resiliently secured to the base, such that the flanges when manually manipulated towards each other the projection tab releases the projection member such that the cover and base are movable to the open configuration.

8. The child resistant closure mechanism of claim 7 further comprising:

an indented surface region on the top surface of the cover positioned around each slot.

9. The child resistant closure mechanism from claim 7 further comprising a series of radial crosspieces outwardly positioned from a central cross ring extending from the cover towards the base and configured to reinforce the resiliency of the cover.

10. The child resistant closure mechanism of claim 7, wherein the manual manipulative locking mechanism further includes a front-end frictional engagement defined by an upwardly extending slot tab about the base that engages one of the radial crosspieces.

11. The child resistant closure mechanism of claim 1 further comprising: a plurality of the closure mechanisms similarly configured and joined together at a periphery by a frangible link and in substantially the same plane, wherein the frangible link when broken permits separation of one closure mechanism secured to a can from the plurality.

12. The child resistant closure mechanism of claim 11, wherein said plurality is two.

13. The child resistant closure mechanism of claim 11, wherein said plurality is four.

14. The child resistant closure mechanism of claim 13, wherein said plurality is six.

15. A child resistant closure mechanism configured for use with a can having a ledge surrounding a top portion of the can and which contents of the can are accessible from the top portion when the can is opened, the closure mechanism comprising:

a base having a base skirt configured to secure to a ledge of the can, wherein the base further includes an annular ring having an outer peripheral edge and an inner peripheral edge to define a base surface there between, an inside base skirt extending downwardly from the inner peripheral edge and an outside base skirt extending downwardly from the outer peripheral edge, the outside base skirt having inwardly extending tabs configured to grip under the ledge of the can when the closure mechanism is secured onto the can;

an opening defined within the inside base skirt of the annular ring;

a cover hinged to the base along an end, the cover configurable into a closed configuration with the base, and wherein the cover has a top surface terminating at a top peripheral edge to a downwardly extending top skirt, the top surface configured to cover a substantial portion of the top portion of the can when the cover and base are in the closed configuration to prevent access to the top portion of the can and moveable into an open configuration with the base;

a removable pull tab connected to a portion of the base and positioned within the opening, the removable pull tab accessible only when the cover is in the open configuration, a pair of frangible notches on either side of the portion of the base by the removable pull tab such that when the removable pull tab is removed, the portion of the base breaks away from the base, whereby the base is removable from the ledge of the can to provide access to the top portion of the can and thus the contents; and a manual manipulative locking mechanism configured to secure the cover and base in the closed configuration, the manual manipulative locking mechanism is configured for manual manipulation to release the cover from the base such that the cover may move into the open configuration and wherein the manual manipulative locking mechanism includes a pinch lock mechanism and a front-end frictional engagement working in concert with each other to secure the cover and base in the closed configuration.

16. The child resistant closure mechanism of claim 15, wherein the base further includes: arcuate members extending into the opening and separately positioned about the pull tab.

17. The child resistant closure mechanism of claim 16, wherein the pinch lock mechanism defined by including:

a pair of arms diametrically opposed to each other and each extending from the inside base skirt inwardly towards each other, each arm having a flange extending upwardly above the annular ring, and a projection tab positioned on an outside surface of the flange;

a pair of slots separately corresponding to the pair of arms, each slot defined in a top surface on the cover to receive a flange when the cover and base are in the closed configuration, each slot includes a projection member configured to act in concert with the projection tab on the flange to secure the flanges and lock the cover and base in the closed configuration; and wherein each flange is resiliently secured to the base, such that the flanges when manually manipulated towards each other the projection tab releases the projection member such that the cover and base are movable to the open configuration.

18. The child resistant closure mechanism of claim 17, wherein front-end frictional engagement defined by an upwardly extending slot tab about the base that engages one of the radial crosspieces.

19. The child resistant closure mechanism of claim 17 further comprising: a plurality of the closure mechanisms similarly configured and joined together at a periphery by a frangible link and in substantially the same plane, wherein the frangible link when broken permits separation of one closure mechanism secured to a can from the plurality.

20. The child resistant closure mechanism of claim 19, wherein said plurality is selected from one of the following: two, four, and six.

* * * * *